US008661739B2

(12) United States Patent
Keenan

(10) Patent No.: US 8,661,739 B2
(45) Date of Patent: Mar. 4, 2014

(54) APPARATUS AND METHOD FOR UTILIZING SPACE UNDER A DECK FOR STORAGE

(76) Inventor: Donald Keenan, Wexford, PA (US)

( * ) Notice: Subject to any disclaimer, the term of this patent is extended or adjusted under 35 U.S.C. 154(b) by 151 days.

(21) Appl. No.: 12/851,742

(22) Filed: Aug. 6, 2010

(65) Prior Publication Data

US 2011/0030308 A1 Feb. 10, 2011

Related U.S. Application Data

(60) Provisional application No. 61/273,662, filed on Aug. 7, 2009.

(51) Int. Cl.
*E04F 19/00* (2006.01)
*E04H 14/00* (2006.01)

(52) U.S. Cl.
USPC ..... 52/27; 52/39; 52/302.2; 52/712; 108/149

(58) Field of Classification Search
USPC ..... 52/302.2, 39, 27, 506.01; 312/242, 245, 312/246, 247; 248/317, 323, 327, 328, 340, 248/343; 108/149
See application file for complete search history.

(56) References Cited

U.S. PATENT DOCUMENTS

| | | | | | |
|---|---|---|---|---|---|
| 2,587,150 | A * | 2/1952 | Hansen et al. | 248/58 |
| 3,331,645 | A * | 7/1967 | Vercellotti | 312/248 |
| 4,446,660 | A * | 5/1984 | Miller et al. | 248/250 |
| 4,527,375 | A * | 7/1985 | Braginetz | 52/712 |
| 4,544,119 | A * | 10/1985 | Kellett et al. | 248/58 |
| 4,699,437 | A * | 10/1987 | Genereaux | 312/248 |
| 5,351,458 | A * | 10/1994 | Lehe | 52/586.2 |
| 5,557,903 | A * | 9/1996 | Haddock | 52/508 |
| 5,628,153 | A * | 5/1997 | Fontanez | 52/39 |
| 5,725,293 | A * | 3/1998 | Wilkening et al. | 312/248 |
| 5,845,979 | A * | 12/1998 | Longhurst et al. | 312/246 |
| 6,164,019 | A * | 12/2000 | Salley | 52/11 |
| 6,233,886 | B1 * | 5/2001 | Andres | 52/177 |
| 6,435,105 | B1 * | 8/2002 | Mikich et al. | 108/42 |
| 6,730,841 | B2 * | 5/2004 | Heckeroth | 136/251 |
| 2005/0188903 | A1 * | 9/2005 | Ryberg | 108/149 |
| 2007/0145222 | A1 * | 6/2007 | Rausch | 248/317 |
| 2008/0036341 | A1 * | 2/2008 | Nilsen et al. | 312/246 |

* cited by examiner

*Primary Examiner* — Chi Q Nguyen
(74) *Attorney, Agent, or Firm* — Blynn L. Shideler; Krisanne Shideler; BLK Law Group

(57) ABSTRACT

An apparatus for utilizing space under a deck for storage includes (a) a first securing element having a first and second portion, wherein the first portion is formed to engage the deck and extends downward therefrom toward the ground; and (b) a storage element sized to be received beneath the deck, wherein the second portion of the first securing element is secured to the storage element. A method utilizes the claimed apparatus.

15 Claims, 42 Drawing Sheets

APPARATUS AND METHOD FOR UTILIZING SPACE UNDER A DECK FOR STORAGE

CROSS REFERENCE TO RELATED APPLICATIONS

This application claims the benefit of U.S. Provisional Patent Application No. 61/273,662 filed Aug. 7, 2009, and entitled "An Apparatus and Method to Utilize the Space Under a Deck for Storage," the contents of which are incorporated herein by reference.

BACKGROUND OF THE INVENTION

1. Field of the Invention

The present invention relates to storage and, more particularly, to an apparatus and method for utilizing space under a deck to provide storage.

2. Description of Related Art

Generally, storage space in a home is limited. Closets, basements and garages seem to not provide enough storage space for homeowners. It is, therefore, desirable to overcome the above problems and others by providing increased storage for homeowners utilizing the existing infrastructure of the home.

SUMMARY OF THE INVENTION

To overcome the deficiencies of the prior art, what is needed, and has not heretofore been developed, is an apparatus and method to utilize previously unused or underused space underneath a deck for storage purposes. Generally, the present invention relates to an apparatus designed to allow the space under a deck to be used for storage. The apparatus includes components that allow it to be suspended from various parts of the deck structure. The general design of the apparatus includes anchoring components (AC), vertical components (VC) and a storage component (SC). An AC is designed to serve as the main point of securement between the deck and the apparatus. The various embodiments of an AC have been designed to allow the apparatus to interact with various parts of the deck structure. It is to be understood that the term "interact", "interaction", and forms thereof relate to connectivity, securement, attachment, fastening, movement, and the like between the indicated components of the various embodiments discussed herein. It is to be understood that the term "deck", in the generic sense is to encompass the decking planks and the joists supporting the planks.

In one embodiment of the apparatus, an AC is designed to interact with the decking surface. The design of an AC in this embodiment is such that part, or all, of the load of the apparatus is carried by the decking. A VC or VCs then extends from an AC to the space below the decking to connect to a storage component. Various embodiments of this AC are described herein.

In another embodiment an AC is a substantially flat element that straddles the space between two deck boards through which a VC may project. An AC may also be constructed to interact with a single deck plank in which case a VC or VCs may project downward through the spaces on either side of the plank. A wedge-like device may be used to tap into the space between dank planks to allow a portion of an AC or a VC to pass through. The shape and size of an AC may be variable. The number of AC's per apparatus is variable. In one embodiment an AC and VC is be positioned to interact with each of the four corners of a rectangular or square SC. An AC may be in continuity with other AC's either across decking planks or within the space between decking places. An AC may be secured to the decking in a variety of fashions including nails, screws, glue, etc. Alternatively, an embodiment is described wherein an underside component (UC) is utilized. A UC is designed to be placed on a VC on the underside of the decking. When displaced upward, a UC may provide a counterforce against an AC on the top of the same decking plank thus securing the AC and VC in place.

In yet another embodiment of an AC interacting with the deck planks, a hole is drilled into a plank with a specialized drill bit (SDB). This SDB creates a two-level beveled hole in a plank. A specialized AC may be used in this setting that allows the AC to rest on the inner bevel of the drilled hole while maintaining a flat profile on the top of the deck. A VC protrudes through the entire hole and below the decking.

Several variations of VCs are described to function with ACs on the deck planking. A VC or VCs may be integrated with an AC or ACs at the time of production. Alternatively, a VC or VCs may be attached to an AC or ACs by the user. The dimensions of a VC may be variable. The VC is designed to attach to an AC on the decking and project through the space between two decking planks. There may be one VC per AC or a VC may be constructed to span two or more ACs within the same decking space.

One embodiment allows for a VC to rotate with respect to an AC allowing for the VC, and thus the storage component, to be oriented in different directions with respect to the decking.

An AC and two VCs may be an integral unit forming an upside down U-shaped element. In one such embodiment of an integrated AC and VCs, the AC and/or VCs may be constructed in a non-rigid fashion resulting in a belt-like component. The belt-like AC may be constructed of various lengths and may therefore span various number of deck planks. In this embodiment the belt-like construction of the AC may be contiguous with one or more vertical components creating a belt-like combined anchoring/vertical component (BCAVC). A BCAVC may extend from a location on the storage component, over several decking planks, and attach to an opposing location on the storage component. In this version a BCAVC may be utilized at the front and a BCAVC may be utilized at the back of a square or rectangular storage component. Alternatively, a BCAVC may extend from a location on the storage component, over a single deck plank, and then attach to the storage component at location near its origin. In this version a BCAVC may be utilized at each corner of a square or rectangular storage component.

A VC may be constructed with functionality that allows it to be displaced upward toward the deck and downward away from the deck. Either a telescoping VC or a scissoring VC may allow an SC to move toward or away from the deck above. In this embodiment, the VC may need to be attached to a portion of the AC that projects below the decking. A handle may be utilized to facilitate movement of an SC.

A VC may be provided as a mechanism of attachment for a storage component (SC). Various embodiments of attachment are proposed including pins on the SC which may interact with either an opening or a hook on a VC. A VC may have openings that allow for a horizontal shelf to be positioned on which an SC may be placed. Alternatively, VCs may be reversibly attached to a platform on which an SC may be placed. The platform may have a sliding functionality that allows for an SC to be moved back and forth. Yet another embodiment describes suspension belts that span VCs and provide a surface on which an SC is placed. A horizontal attachment component (HAC) may be utilized for attachment of VCs to an SC. The HAC may interact with two or more VCs and provide a larger surface area for attachment to a SC. The attachment of a VC or HAC to an SC may be secured using mechanisms such as screws or bolts.

The apparatus may be designed to interact with the joists. The design of an AC in this embodiment is such that part, or all, of the load of the apparatus is carried by the joists. In this embodiment of the apparatus, a joist anchoring component (JAC) is utilized. A JAC is designed to be placed within the space between decking planks and rest on the joists that are perpendicular to the planks. In one version, a JAC may be an inverted U-shaped element. The base of the inverted U may rest on a joist between decking planks while the longer arms of the U may project below the deck to interact with a storage component, thus functioning as an integrated AC and VC. To create a more stable JAC, two or more JACs may be connected to create a connecting joist anchoring component (CJAC). In this version of a CJAC, elements may link together two or more JACs. These connecting elements may be constructed to allow them to pass through the space between the decking planks. The long arm of a U-shaped JAC or CJAC may be constructed with any of the previously described elements of VCs that allow connection with an SC.

In another embodiment of the apparatus that utilizes joists as an anchoring point, a wire-like anchoring component (WLAC) may be used. A WLAC may include a wire or rope-like element that may attach to a storage component. The WLAC may then pass upward through the space between two decking planks and then rest on one or more joists while running perpendicular to the joists. The WLAC may then pass downward and reattach to the storage component. In this embodiment, the WLAC may essentially function as an integrated AC and VCs. The wire-like nature of this AC may permit the user to control the displacement of the storage component with respect to the deck. A WLAC guide may be utilized. The guide may be placed on a joist between two deck planks. The guide may have a low profile may remain below the level of the decking and provide a better surface on which a WLAC may rest and move. A WLAC or WLACs may be constructed with handles. This may allow the user to better control the movement of a WLAC or WLACs.

The apparatus may be designed to interact with the beams. The design of an AC in this embodiment is such that part, or all, of the load of the apparatus is carried by the beams. In this embodiment of the apparatus, a beam anchoring component (BAC) may be utilized. In one embodiment, a BAC may include a horizontal element that may span the distance between two beams. At either end of this horizontal element, a component may be present to allow the BAC to rest on a beam and also prevent displacement of the BAC. The horizontal element may be constructed with components that allow an SC to be directly suspended from the element. In one such design, rail-like ledges may span two or more BACs and a T-shaped element on an SC may interact with the ledge. The SC may be moveable along the rail-like ledge in this embodiment.

A BAC may also be constructed so that no horizontal element is utilized. In these embodiments, a BAC may be designed in an upside down square J-shaped fashion. The shorter arm of the J-shaped BAC may be placed on the beam. The longer arm of the J-shaped BAC may then project away from the deck and allow for a point of attachment for a SC, thus creating an integrated AC and VC. The long arm of a J-shaped BAC may be constructed with any of the previously described elements of VCs that allow interaction with an SC. Alternatively, the long arm of the J-shaped BAC may interact with various elements such as shelves and platforms that then provide a mechanism of interaction with an SC.

In some embodiments, the apparatus may be incorporated into the initial construction of the deck. In this embodiment, specialized deck planking, joists or beams may be utilized, wherein vertical components have been integrated into the plank, joist or beam. These same components may also be utilized in an embodiment where original decking planks are removed and replaced with an element where a specialized decking plank with integrated vertical components is utilized. Various attachment mechanisms may then be utilized to interact with an SC.

Depending on the height of the deck, it may be useful for the storage component to move up and down and toward and away from the deck. This functionality may be achieved by utilizing specialized vertical components. In one embodiment a VC may be constructed with telescoping elements, wherein the length of a VC, and thus the distance of a storage component from the deck, is modifiable as elements of a VC are either internalized into or externalized out of successive VC elements. Alternatively, the same functionality may be achieved by utilizing a scissoring mechanism.

In one embodiment, the present invention includes an apparatus for utilizing space under a deck for storage, wherein the apparatus includes (a) a first securing element having a first and second portion, wherein the first portion is formed to engage the deck and extends downward therefrom toward the ground; and (b) a storage element sized to be received beneath the deck, wherein the second portion of the first securing element is secured to the storage element. The apparatus may include a second securing element having a first and second portion, wherein the first portion is formed to engage the deck and extends downward therefrom toward the ground, wherein the second portion of the first securing element is secured to one portion of the storage element and the second portion of the second securing element is secured to another portion of the storage element. One portion of the storage element may be defined on one side of the storage element and the another portion of the storage element may be defined on an opposite side of the storage element. The first portion may include a first and second elongate member, wherein the first elongate member is substantially perpendicular to the second elongate member, and wherein the second elongate member is sized to be received in a space defined between two planks of the deck. The first and second securing elements may be sized to be received through a first and second hole defined within a respective first and second plank of the deck. The respective first portions of the first and second securing elements may be formed to engage two sides substantially perpendicular to each other of respective joists of the deck. The respective first portion of the first and second securing elements may be secured to the respective joists via fasteners (e.g., nut/bolts, screws). The first and second securing elements may be extendable in a direction perpendicular to the deck. The storage element may be movable in a direction parallel to the deck. The storage element may be substantially planar and may be connected to the respective second portions of the first and second securing elements. The storage element may include an enclosure having at least one open end.

In another embodiment, the present invention includes an apparatus for utilizing space under a deck for storage, wherein the apparatus includes (a) a first and second flexible wire sized to be received in respective spaces defined between a first set of planks and a second set of planks of the deck, wherein the first and second wires include respective first and second ends; and (b) a storage element sized to be received beneath the deck, wherein the first and second ends of the first wire are secured to a first set of opposite ends of the storage element, and wherein the first and second ends of the second wire are secured to a second set of opposite ends of the storage element. The apparatus may further include a first set and second set of anchoring guides, wherein the first and second anchoring guides are sized to be securely received onto a respective first and second joist of the deck. Each of the anchoring guides may include a channel at least as wide as the width of the first or second wire. The storage element may include an enclosure having at least one open end.

In another embodiment, the present invention includes a method for utilizing space under a deck for storage, wherein the method includes the steps of (a) lowering a first securing element through a space defined between a first and second plank of the deck, wherein a first portion of the first securing element is secured against at least the first or second plank; (b) lowering a second securing element through a space defined between a third and fourth plank of the deck, wherein a first portion of the second securing element is secured against at least the third or fourth plank; and (c) securing a storage element to respective second portions of the first and second securing elements, wherein the storage element is situated beneath the deck. The storage element may include an enclosure having at least one open end.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE INVENTION

Figure 1:
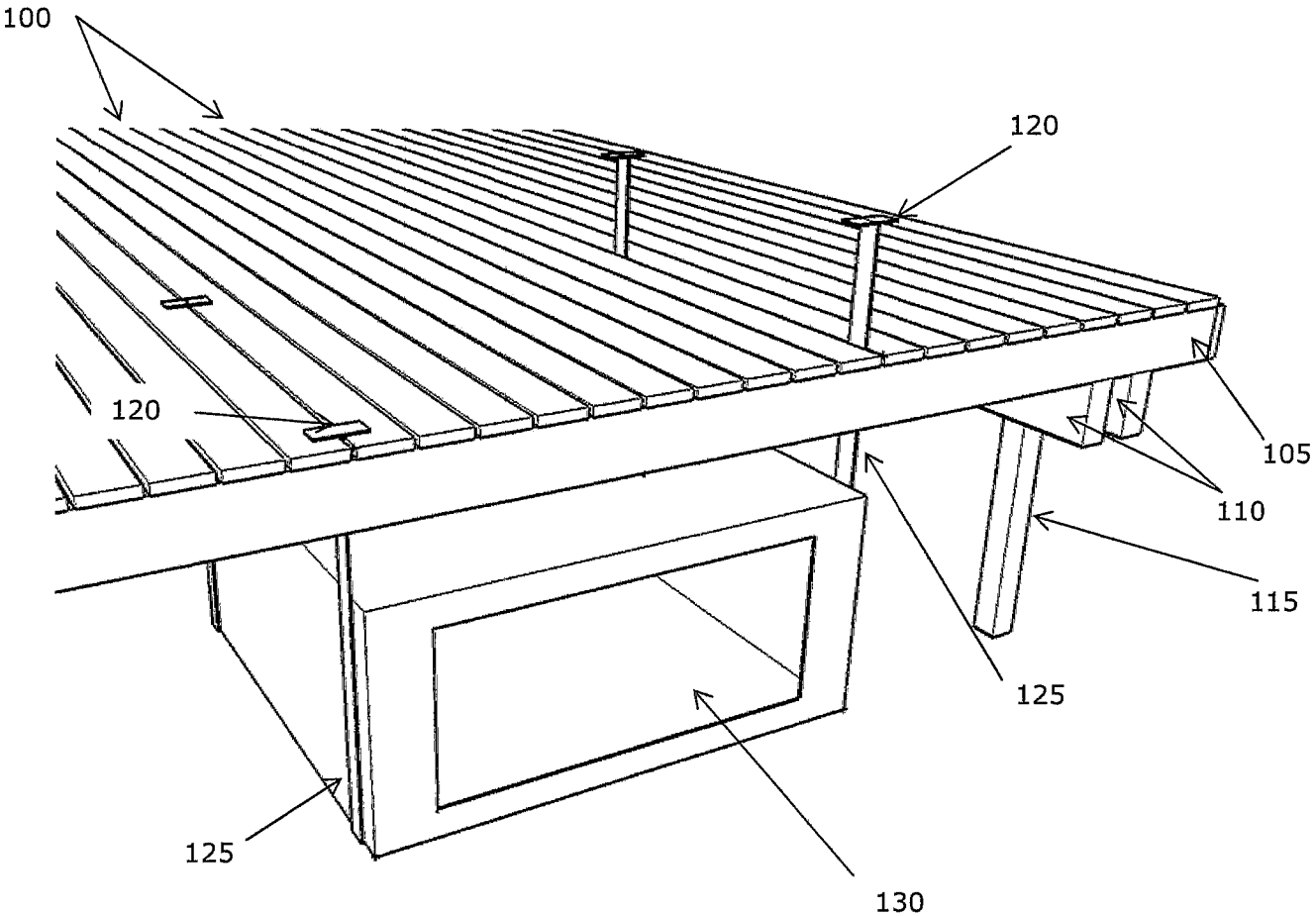
FIG. 1 is a perspective view of a deck anchoring apparatus according to a first embodiment.

The present invention will now be described with reference to the accompanying figures. For purposes of the description hereinafter, the terms "upper", "lower", "right", "left", "vertical", "horizontal", "top", "bottom" and derivatives thereof shall relate to the invention as it is oriented in the drawing figures. However, it is to be understood that the invention may assume various alternative variations and step sequences, except where expressly specified to the contrary. It is to be understood that the specific apparatus illustrated in the attached figures and described in the following specification is simply an exemplary embodiment of the present invention. Hence, specific dimensions and other physical characteristics related to the embodiments disclosed herein are not to be considered as limiting.

In all of the embodiments described above the apparatus may be constructed with functionality that prevents the storage components from being filled with material that may place excessive weight on the deck structure. This functionality may be achieved via a "break-away" design built into any of the apparatus' components or interactions. For example with excessive weight in the storage component a vertical component may be designed to separate from a horizontal component, a horizontal component may be designed to separate from an attachment pin or an attachment pin may be designed to separate from a storage component. Alternatively, vertical components may be constructed with failure seams that may separate at a predetermined load. Also, the floor of a storage component may also be constructed to break away when a certain load is placed in the storage component. One possible mechanism for this breakaway functionality may be the utilization of perforation seams that may impart a point of separation that may be designed to fail and separate at a predetermined weight load.

FIG. 1 depicts an embodiment of the apparatus in which the anchoring component is on the decking. The deck in the figure includes decking (100) joists (105) beams (110) and posts (115). In this embodiment, anchoring components (AC) (120) are designed to rest on the deck planks (100). The shape and size of the AC may be variable. The ACs are shown as interacting with vertical components (VC) (125). An AC and VC may be integrated at the time of manufacturing. Alternatively, an AC and a VC may be reversibly or irreversibly assembled at the time of need. A VC is designed to pass through the narrow space between deck planks (100) and interact with a storage component (SC) (130). This interaction may occur utilizing several embodiments. In the figure a VC may interact with an SC via various mechanisms including bolts or screws. The VC may be "L"-shaped so that an SC rests on a portion of a VC to provide a horizontal surface on which a SC may rest providing more support. In another embodiment a SC may be oriented perpendicularly to the decking planks (100).

Figure 2:
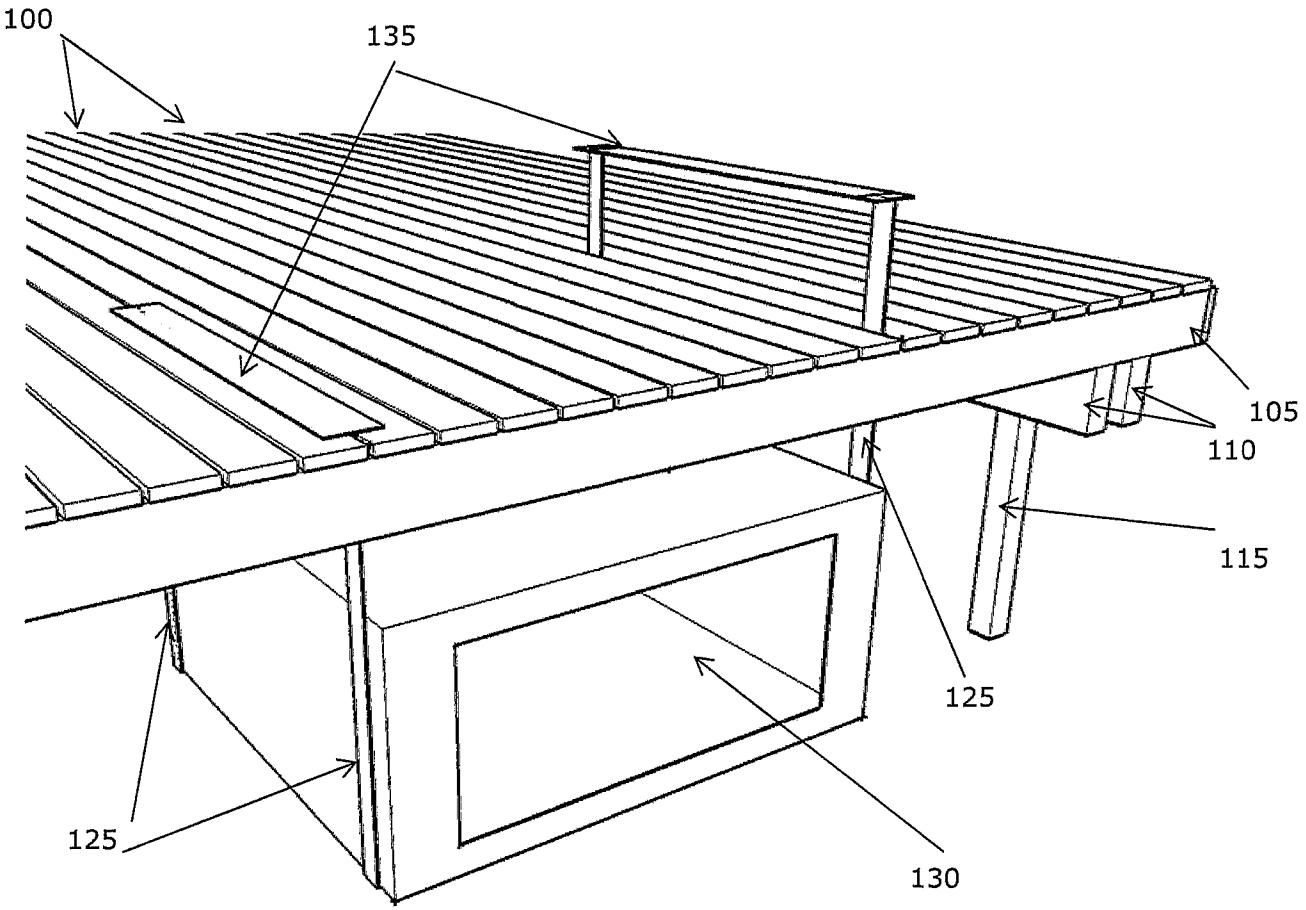
FIG. 2 is a perspective view of a deck anchoring apparatus according to a second embodiment.

FIG. 2 depicts an embodiment of the apparatus in which the anchoring component is on the decking and anchoring components are connected. In this figure two or more VCs are shown interacting with the same anchoring component. This connecting anchoring component (CAC) (135) may serve to distribute the load of the apparatus over a larger surface of the deck planks (100).

Figure 3:
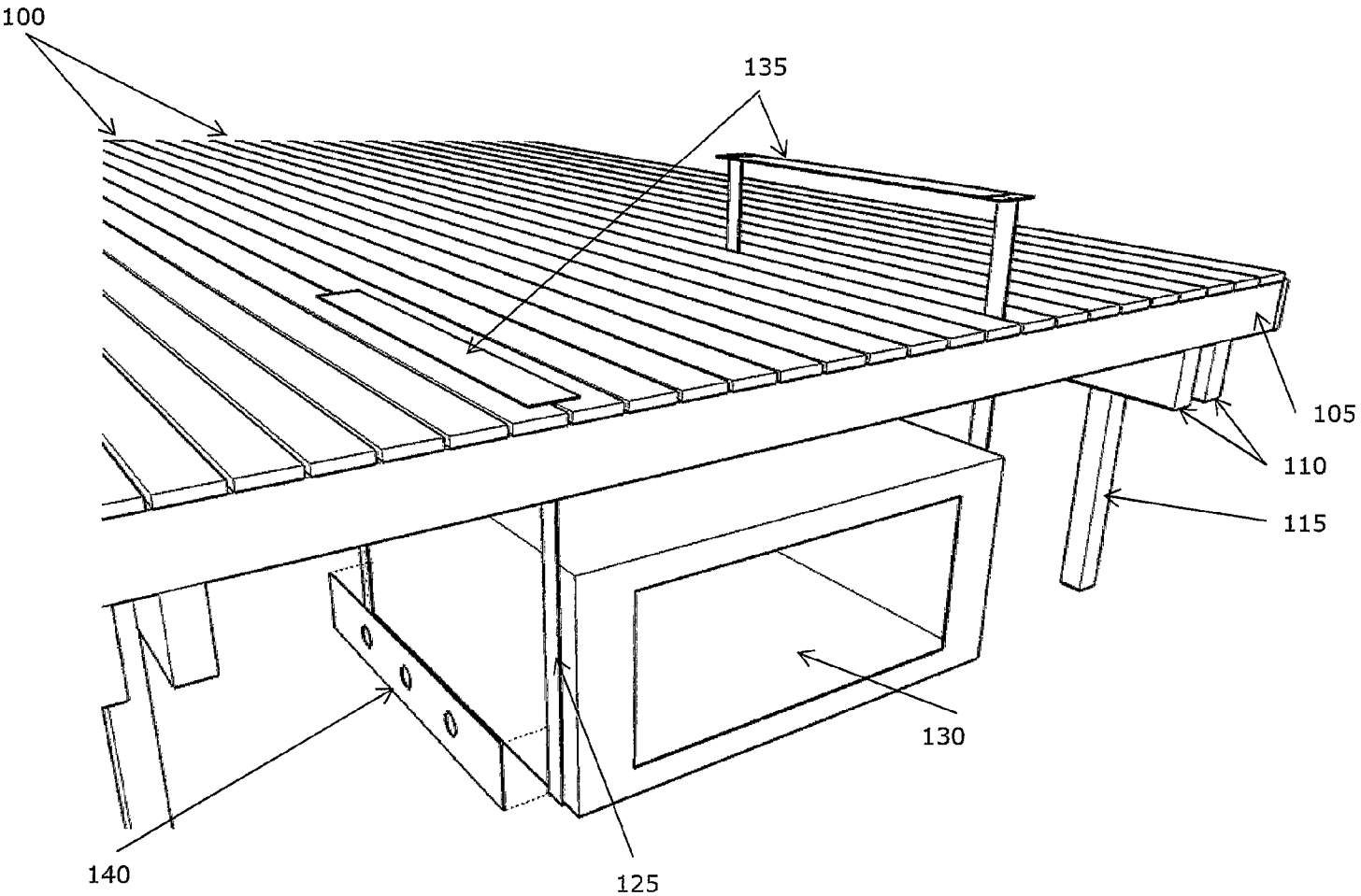
FIG. 3 is a perspective view of a deck anchoring apparatus according to a third embodiment.

FIG. 3 depicts an embodiment of the apparatus in which a specialized component may be utilized to attach vertical components to a storage component. In the figure, a horizontal anchoring component (HAC) (140) is shown prior to its attachment to vertical components. An HAC may interact with two or more VCs. The method of attachment of an HAC to VCs is variable. In one embodiment, an HAC may simply be attached with bolts or a similar mechanism. An HAC may have a horizontal component, like an "L"-shaped VC, so that a ledge may be created to provide additional support for a storage component. An HAC may interact with a storage component via various mechanisms. In one embodiment, bolts or screws or similar mechanisms may be utilized.

Figure 4:
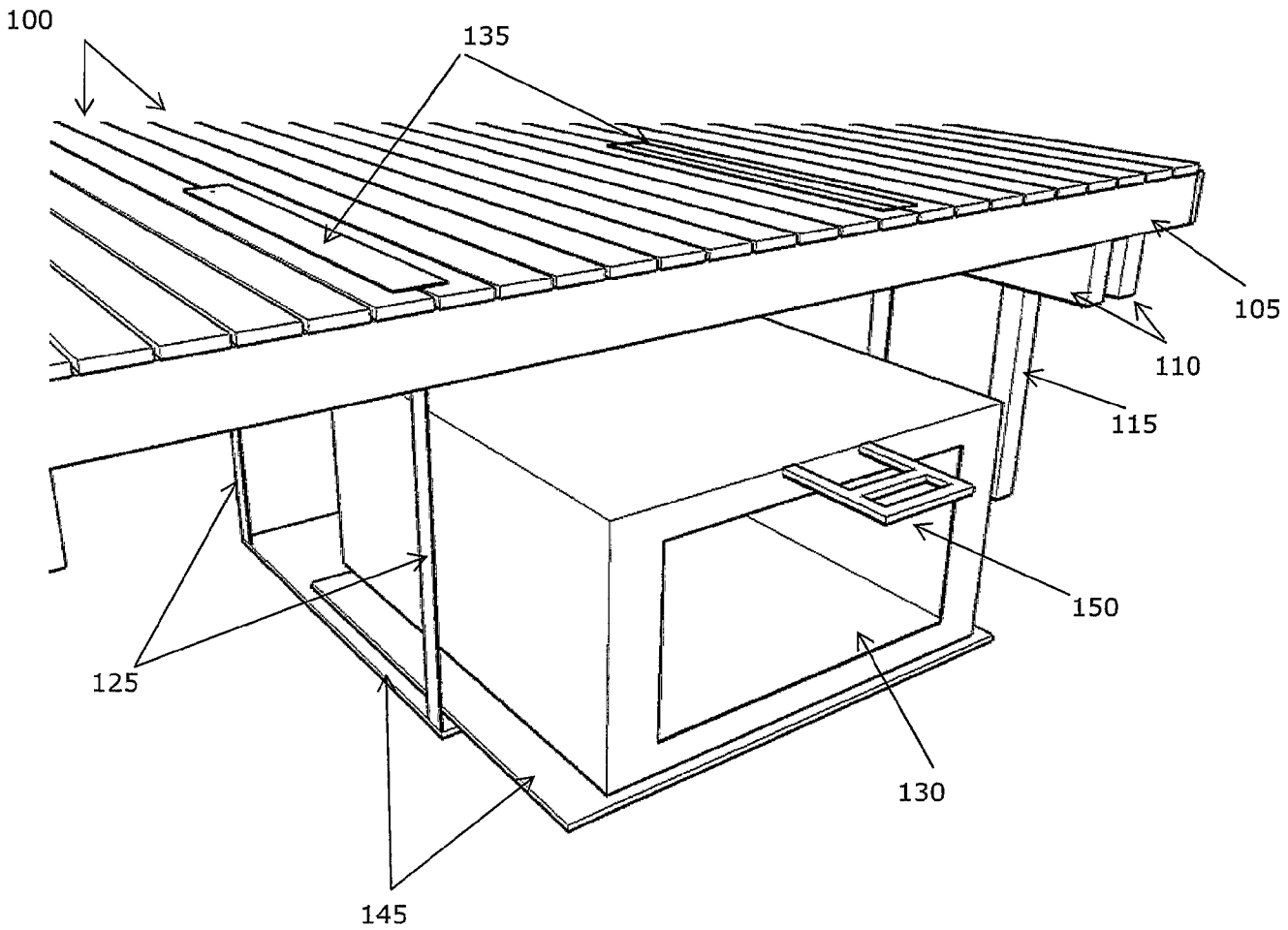
FIG. 4 is a perspective view of a deck anchoring apparatus according to a fourth embodiment.

FIG. 4 depicts an embodiment of the apparatus in which a platform is utilized. In the figure a sliding platform (SP) (145) is shown as interacting with vertical components. An SP may interact with a variable number of VCs. An SP may interact with VC via various mechanisms. In a one embodiment of the apparatus, an SP may be secured to VCs using bolts or similar techniques. An SP is designed to allow a user to move a storage component from a position under the deck to a position that is more accessible. In the figure, the SP may include two components. One component is designed to interact with VCs. A second component is shown on top of the first and may slide on top of the first component. This sliding action may be achieved utilizing various mechanisms. In one embodiment, a series of rollers may be placed on the bottom (non-moveable) component. This may allow the top component, and thus the SC to move. Alternatively, wheels may be placed on the upper component that may move within tracks on the lower component. A handle (150) may be utilized to facilitate movement of the SC. An SC may be secured to a SP utilizing various mechanisms including bolts.

Figure 5:
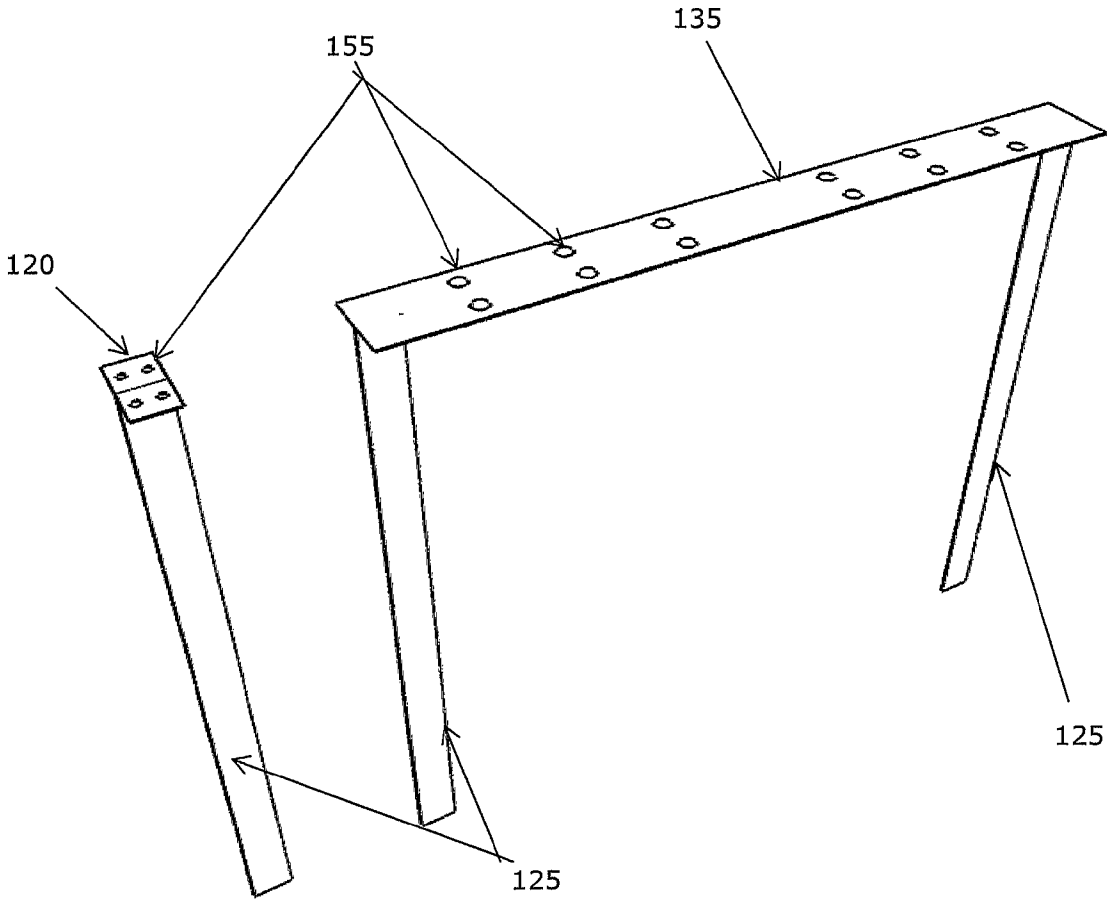
FIG. 5 is a perspective view of anchoring components used in the embodiments shown in FIGS. 1-4.

FIG. 5 depicts embodiments of anchoring components and vertical components. On the left an anchoring component (AC) (120) is shown interacting with a vertical component (VC) (125). An AC may interact with a VC either reversible or irreversible manner. A VC may be placed through the space between two deck planks (100) bringing the AC in contact with the planking (100). The end of a VC opposite the AC may interact with a storage component (not shown). On the right in the figure is an embodiment of an AC wherein an AC interacts with two or more VCs. This connecting anchoring component (CAC) (135) provides a greater area of contact between the deck planking (100) and the apparatus. As in the other embodiment the CAC may connect either in a reversible or irreversible manner with VCs. Also as in the other embodiment the VCs may be placed through the space between two deck planks (100) allowing for a VC to interact with a storage component under the deck. In both embodiments screw holes (155) may be utilized. The screw holes may allow for the user to more securely place the apparatus on the deck. In one embodiment of an AC the surface of the AC that rests on the deck planking (100) may be constructed with nail-like points. The user may then hammer the AC to the planks (100).

Figure 6:
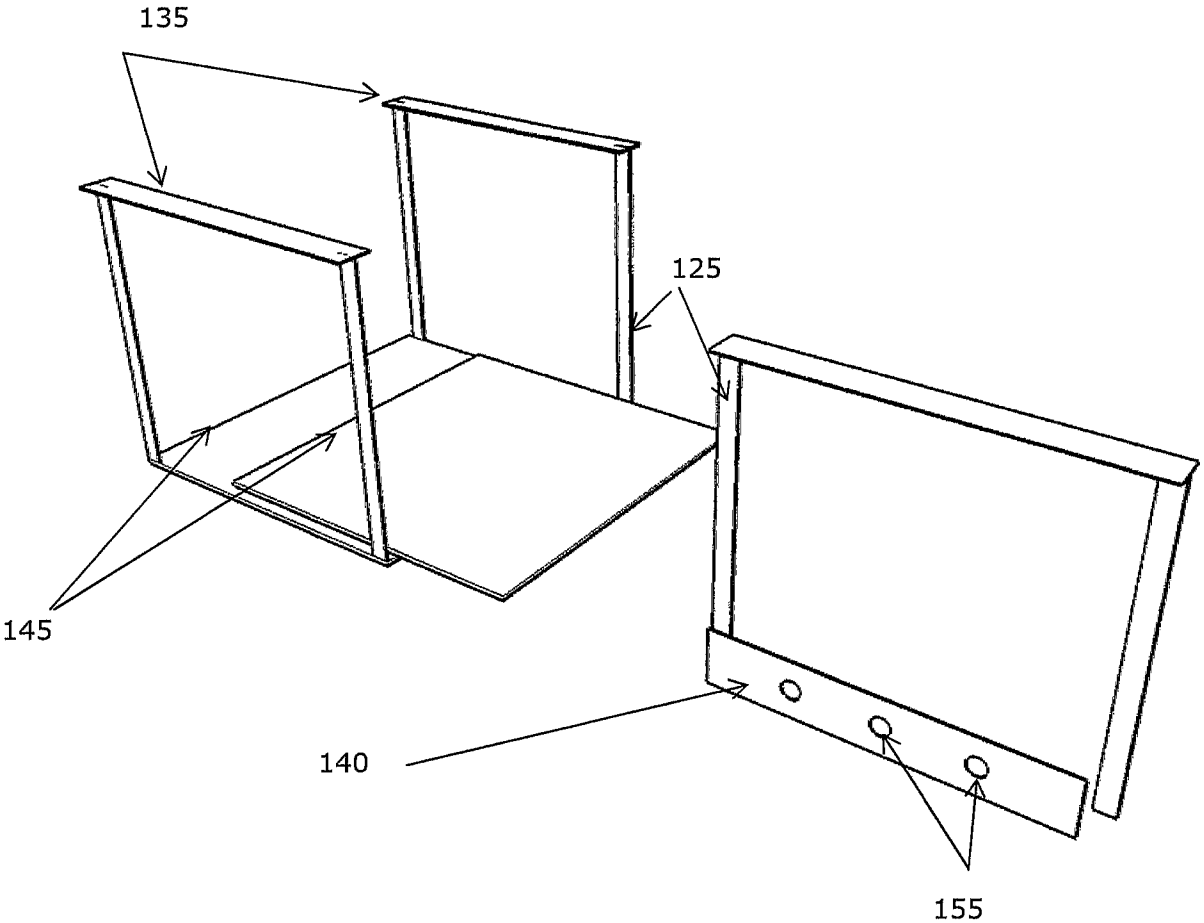
FIG. 6 is a perspective view of a horizontal attachment and sliding platform used in the embodiments shown in FIGS. 3 and 4, respectively.

FIG. 6 depicts embodiments of components that may allow storage components to interact with the other elements of the apparatus. In the upper left is a figure of a sliding platform (SP) (145). An SP may provide a method of interacting with a storage component. In the figure, the SP is shown as having two elements. One element interacts with vertical components. The second element is designed to interact with the first element in a fashion that may allow it to slide. The sliding mechanism may occur via various mechanisms including rollers and wheels on tracks. The storage component may be placed on the moveable element allowing the user to move the storage component out from under the deck for access and back under the deck for storage. An SP may connect to vertical components (VC). An SP may interact with VCs in either a reversible or irreversible manner. In the version wherein an SP attaches reversibly to VCs this attachment may occur either before or after a VC is placed through the deck planks (100). In the version wherein an SP attaches irreversibly to VCs the SP-VCs element may then be placed upward through the deck planks (100) at which time ACs may be attached. The SP-VC may be connected to any of the ACs described. In the lower right is a figure of a horizontal attachment component (HAC) (140). An HAC may extend between and attach to vertical components (VC). An HAC may attach to two or more VCs. An HAC may attach to VCs either prior to or after the VCs have been placed through the space between the deck planks (100). The attachment of an HAC to VCs may occur via various mechanisms. In one embodiment, an HAC may be simply bolted to VCs. Alternatively, an HAC may be placed into slots on the VC. Also, a variety of hooks or latches may be utilized. The use of an HAC may provide additional contact area for a storage component. In the figure, screw holes (155) are shown that may allow a storage component to be attached to the other elements of the apparatus in a more secure fashion.

Figure 7:
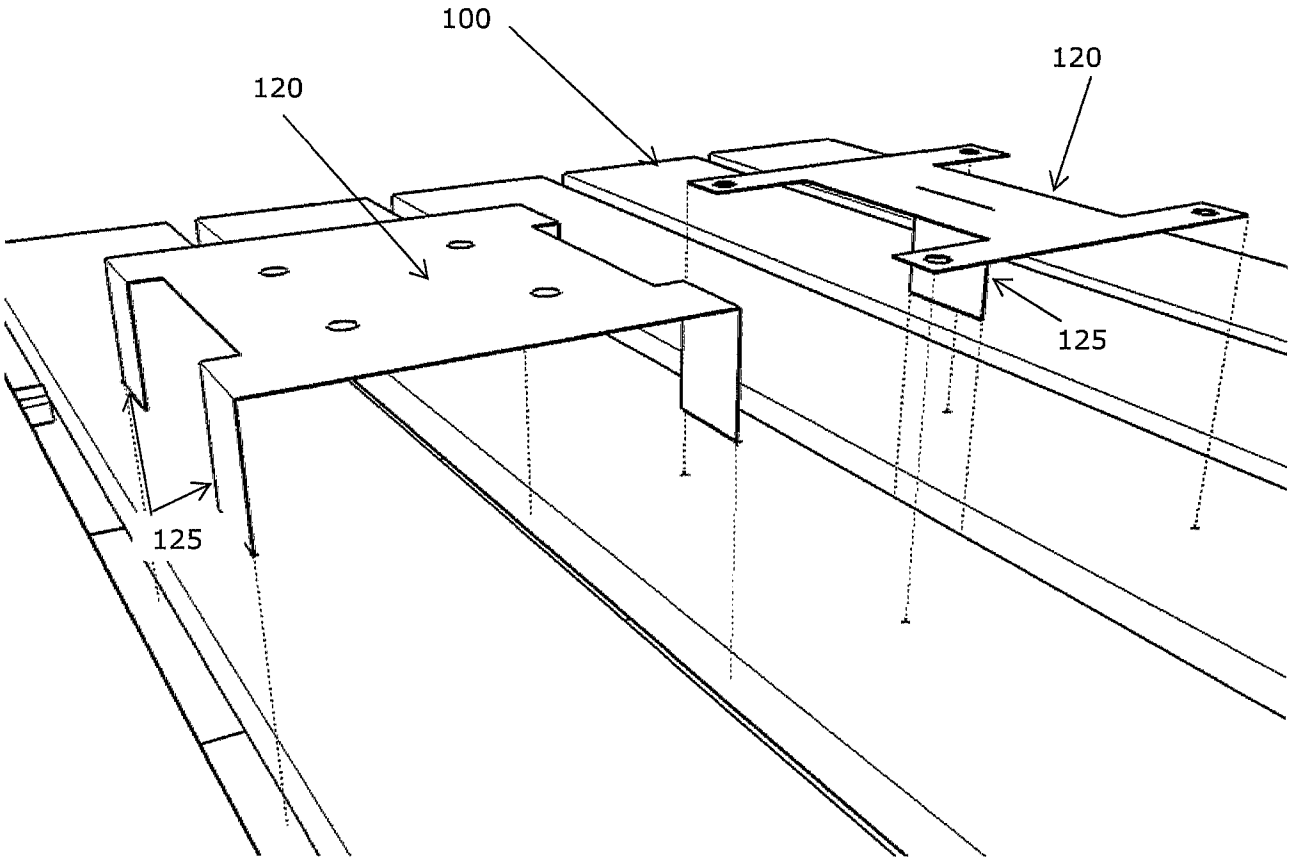
FIG. 7 is a perspective view of anchoring embodiments according to a first embodiment.

FIG. 7 depicts embodiments of anchoring components. In the left of the figure an anchoring component (AC) (120) is shown as spanning a single deck plank (100). In this embodiment the AC rests on a single deck plank (100). On either side of the plank (100) the AC may either be in continuity with, or attach to, a vertical component (VC) (125) in the space on either side of the plank (100) on which the AC rests. In the embodiment wherein this AC attaches to a VC the VC may attach at the level of the deck. Alternatively, the AC may be constructed with elements that pass through the space between the planks (100) allowing for attachment below the level of the deck. In the figure on the right, an AC is shown as spanning two deck planks (100). In this embodiment the AC may either be in continuity with, or attach to, a VC in the space between the planks (100) on which the AC rests. As in the AC embodiment on the left a VC may attach at the level of the deck. Alternatively, the AC may be constructed with elements that pass through the space between the planks (100) allowing for attachment below the level of the deck. The figure shows that either AC may be constructed with holes that allow screws to be utilized to secure an AC to the deck planks (100).

Figure 8:
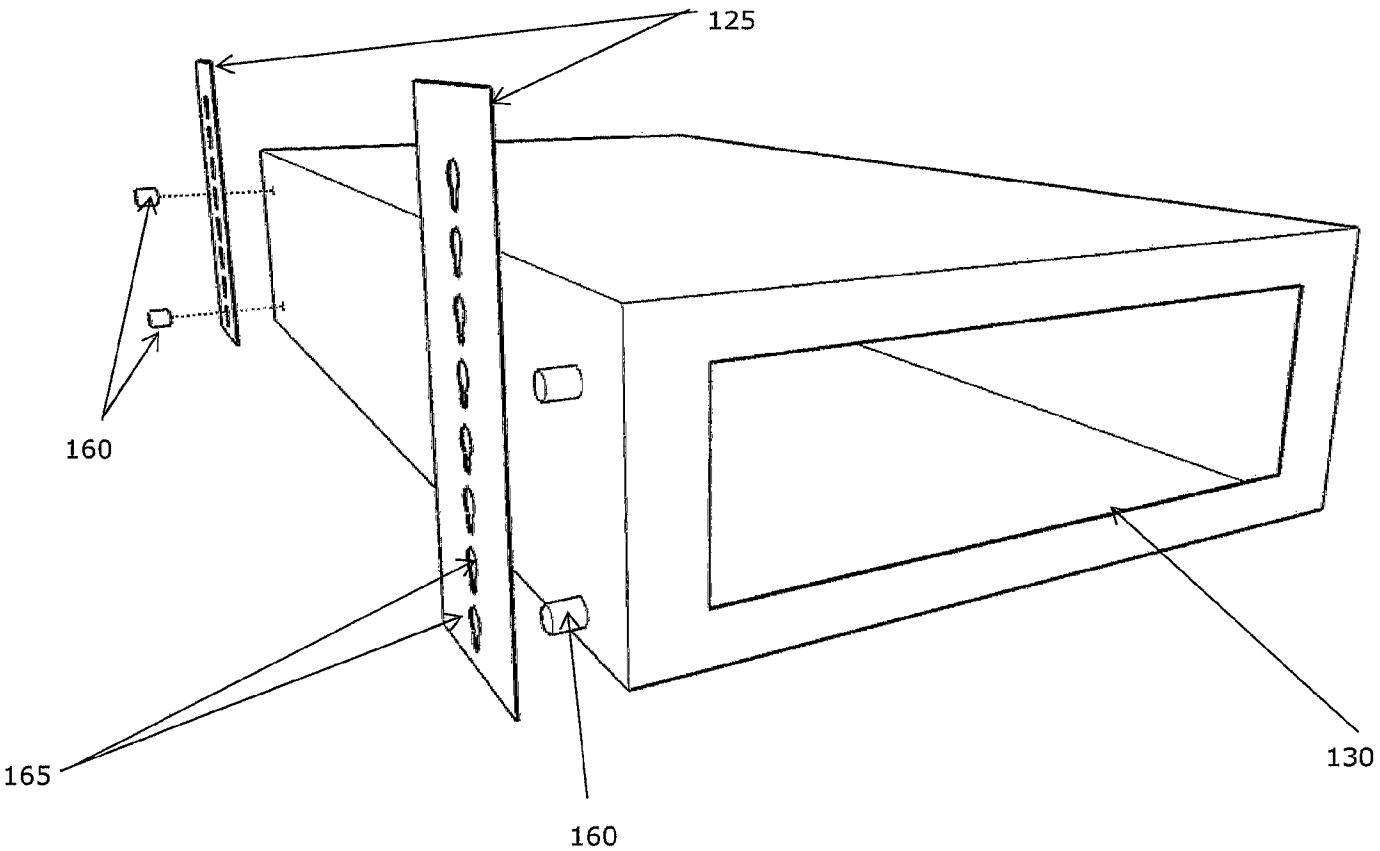
FIG. 8 is a perspective view of a storage component attachment mechanism according to a first embodiment.

FIG. 8 depicts an embodiment of a mechanism of attachment of a storage component to vertical components. In the figure, a storage component (SC) (130) is shown. Attachment pins (AP) (160) may be positioned at various locations on an SC. An AP may be an integral component of an SC as shown on the front of the SC. Alternatively, an AP may attach in a reversible manner using various mechanisms such as a screw. An AP is one mechanism by which an SC may interact with vertical components (VC) (125). In the figure, vertical components are shown that may include vertical component openings (VCO) (165). A VCO may be created as various designs. In the figure, a VCO may include an upper larger opening that is in continuity with a smaller lower opening. In this design the larger opening may provide easier access for an attachment pin into the opening. The size of the upper opening may allow the pin to move within the upper opening thus allowing movement of the and thus facilitating the placement of other APs into openings. Once a pin is in opening, the SC may be positioned so that the SC moves into the smaller opening. The size of the smaller opening is such that the AP, and thus the SC, may be less mobile. An SC may be elevated, thus moving APs out of the lower smaller opening and into the larger upper opening which may facilitate removing the APs from the VC. A VC may include pliable material. This may allow the VC to be moved toward and away from the AP and SC thus facilitating the placement of an AC into an opening. VCOs may be positioned anywhere on a VC. In one embodiment, a series of VCOs are present arranged along the length of a VC. This arrangement may allow the user to change the position of the SC with respect to a VC.

Figure 9:
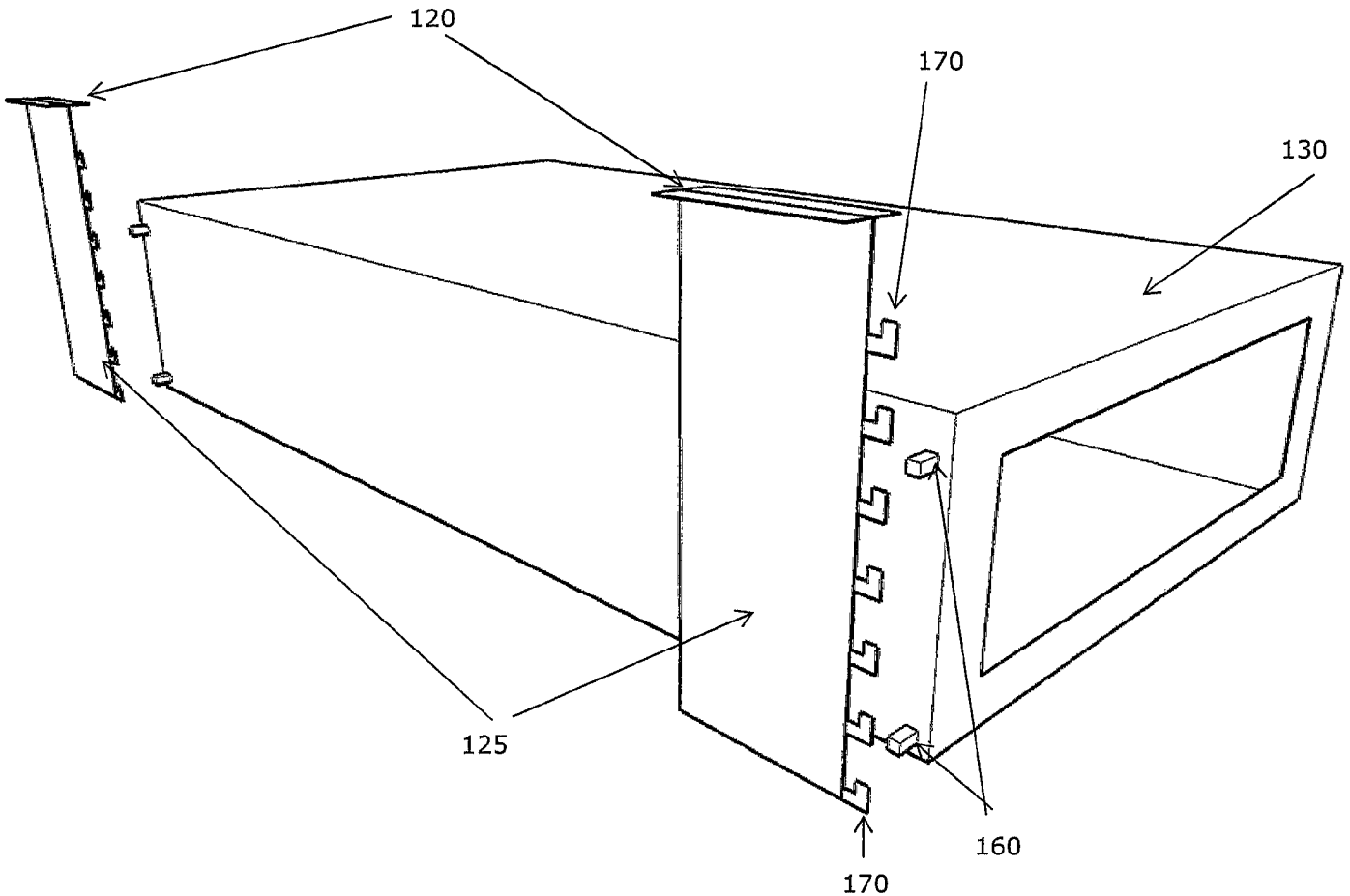
FIG. 9 is a perspective view of a storage component attachment mechanism according to a second embodiment.

FIG. 9 depicts an embodiment of a mechanism of attachment of a storage component to vertical components. In the figure, a storage component (SC) (130) is shown. Attachment pins (AP) (160) are positioned at various locations on an SC. An AP may be an integral component of an SC as shown on the front of the SC. Alternatively, an AP may attach in a reversible manner using various mechanisms such as a screw. An AP is one mechanism by which an SC may interact with vertical components (VC) (125). In the figure, vertical components are shown that include vertical component hooks (VCH) (170). A VCH may be created as various designs. In the figure, an embodiment of a VCH is shown having a substantially horizontal element and a substantially vertical element. In this design the horizontal element may provide a surface on which an AP may be positioned. The dimensions of this horizontal element may be variable. A VCH may also include a vertical element. A vertical element may be positioned at the end of a horizontal element. The position of this vertical element may prevent movement of an AP on the horizontal element. The dimensions of the horizontal element and the vertical element may be variable and may determine the mobility of an AP, and thus an SC, in relationship to the VCs. A VC may include pliable material. This may allow the VC to be moved toward and away from the AP and SC thus facilitating the placement of an AC into an opening. VCHs may be positioned anywhere on a VC. In one embodiment, a series of VCHs are arranged along the length of a VC. This arrangement may allow the user to change the position of the SC with respect to a VC. A VCH may be positioned on the front or back of a VC. This embodiment of attachment may also provide a mechanism that may allow a SC to be oriented perpendicular to the decking planks (100).

Figure 10:
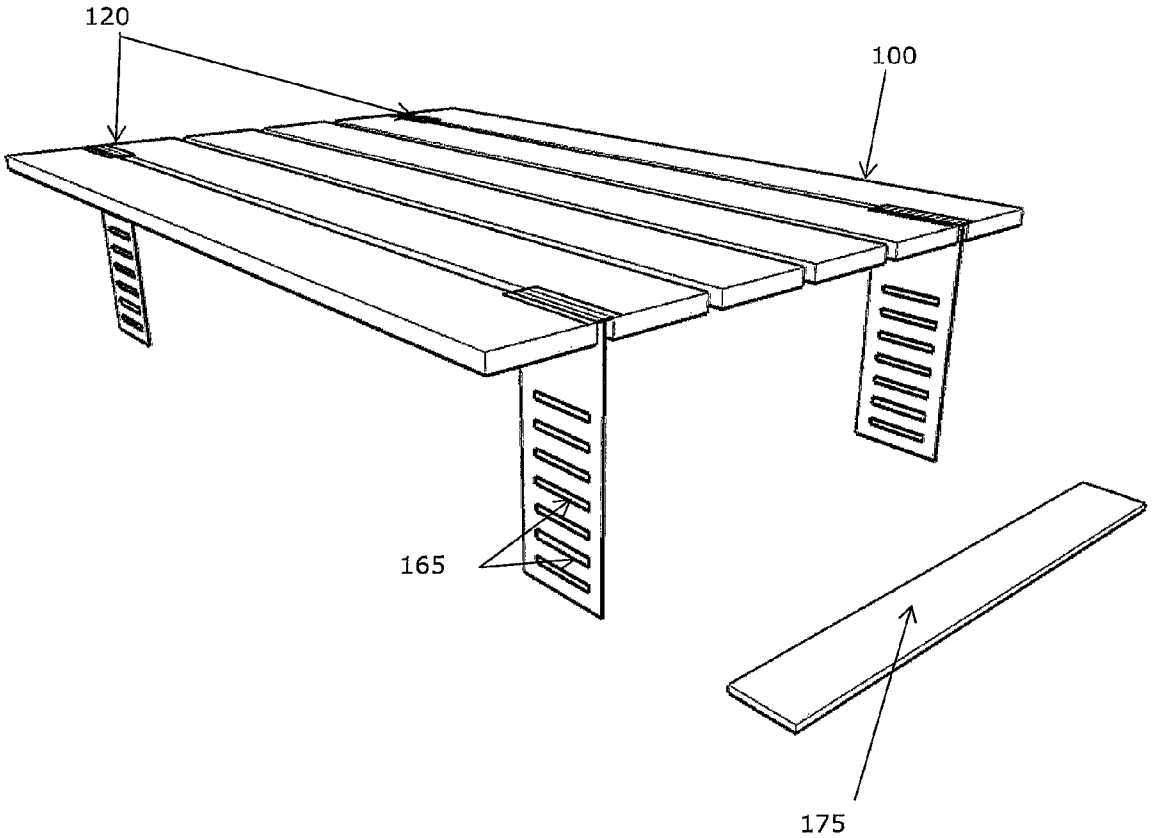
FIG. 10 is a perspective view of a storage component suspension mechanism according to a first embodiment.

FIG. 10 depicts an embodiment of a mechanism of attachment of a storage component to vertical components. In the figure, specialized vertical components are shown that include vertical component openings (VCO) (165). In this figure of the apparatus, a VCO is substantially rectangular in design and intended to accommodate a suspension shelf (SS) (175). In one embodiment of the apparatus, four vertical components may be utilized to interact with two SSs. A storage component (SC) may then be placed on the two SSs. The bottom of an SC may be created with grooves that may be of dimensions similar to that of an SS. This may allow the groove of an SC to be placed on an SS and limit the motion of the with respect to the SS.

Figure 11:
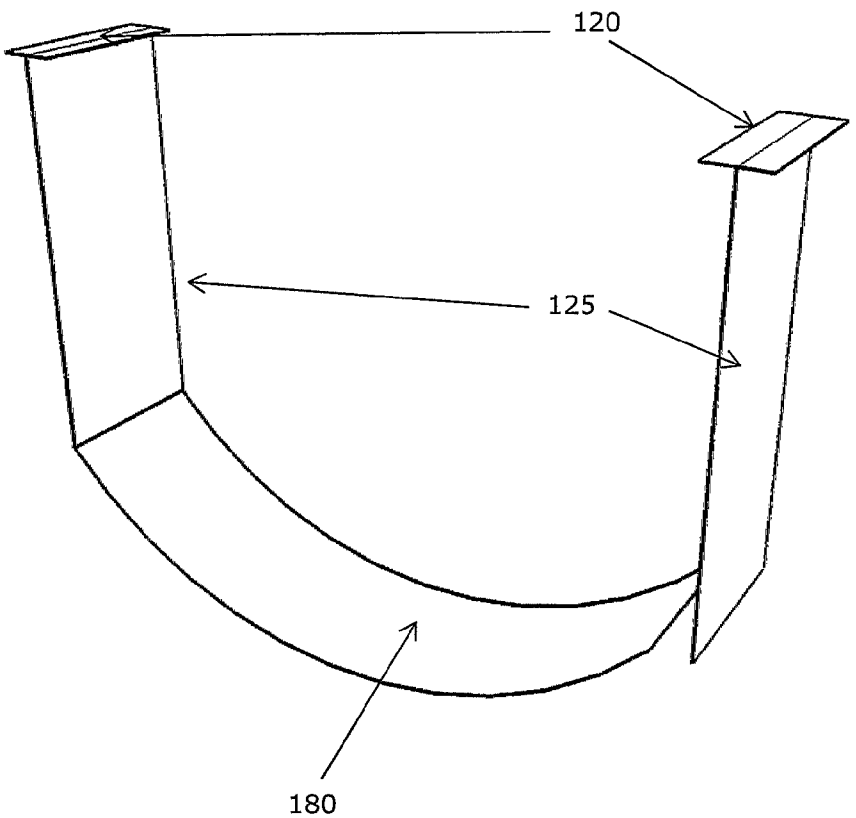
FIG. 11 is a perspective view of a storage component suspension mechanism according to a second embodiment.

FIG. 11 depicts an embodiment of a mechanism of attachment of a storage component to vertical components. In the figure, two vertical components (VC) (125) are shown. A suspension belt (SB) (180) is shown spanning the two VCs. An SB may be attached to one VC prior to placement of the VC onto deck. In this embodiment the free end of the SB may then be passed through the spacing between two deck planks (100) in a manner similar to a VC. The SB may then be attached to the second VC and pulled taught to provide a surface on which a storage component may rest. The attachment of an SB to a second VC may occur utilizing various mechanisms. In one embodiment, a mechanism similar to a belt and buckle may be utilized.

Figure 12:
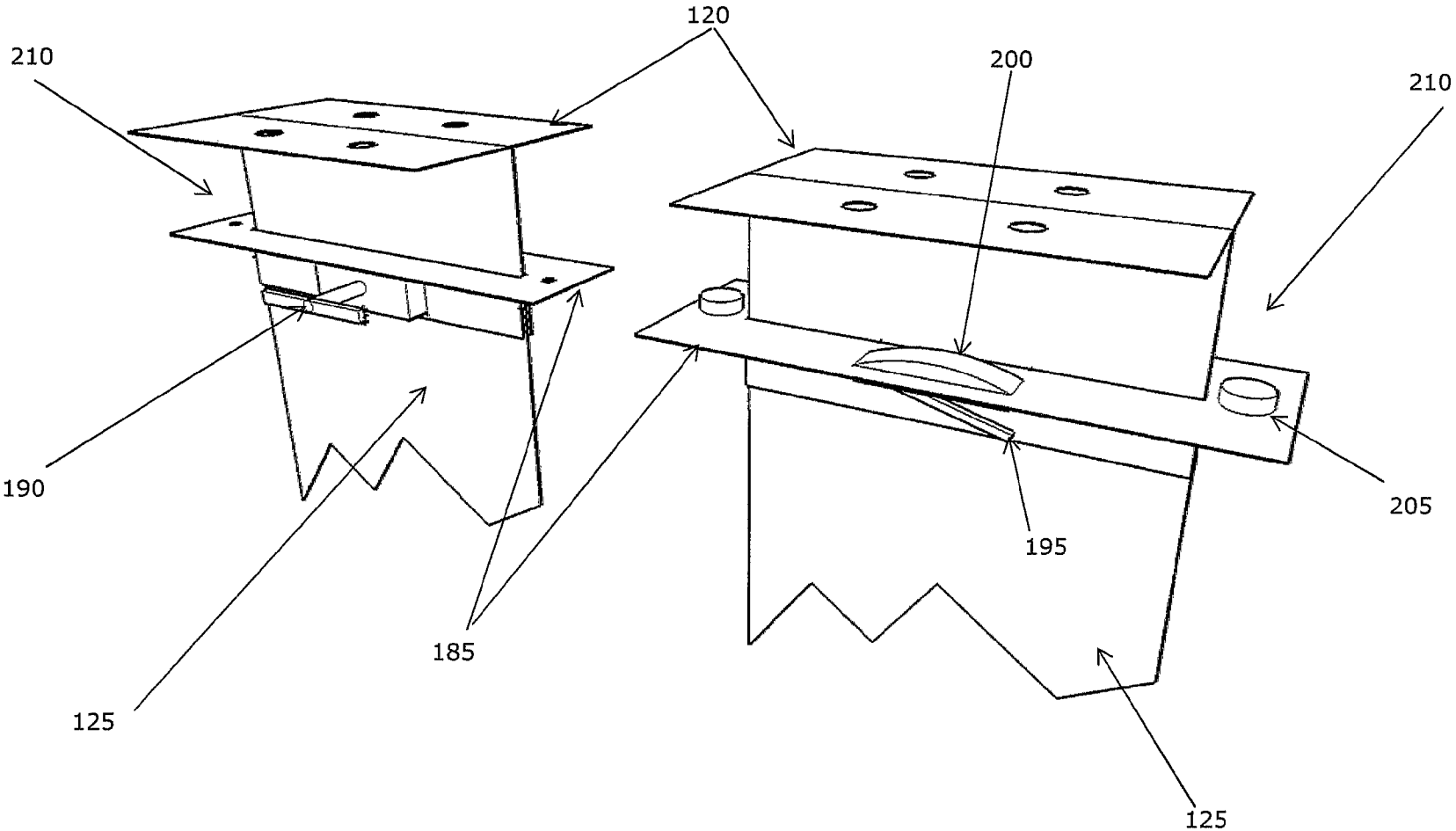
FIG. 12 is a perspective view of a deck securement mechanism according to a first embodiment.

FIG. 12 depicts an embodiment of mechanisms that may be utilized to create a more secure interaction between the deck and the apparatus. Two embodiments of components of the apparatus that utilize an underside component (UC) (185) are shown. An anchoring component (AC) (120) and a vertical component (VC) (125) are shown. The AC may be resting on the top of the deck surface and the VC may be projecting between two deck planks (100) into the space below the deck. A decking plank (100) may thus be present on either side of the vertical component in what is labeled as the decking space (DS) (210). In both of the embodiments shown a UC has been placed on the VC. The UC may be constructed as an element that may be assembled on the VC. In one embodiment, the UC may include two, mostly symmetrical pieces that may be bolted together around a VC. Alternatively, a UC may be a component that needs no assembly by the user. In this version the opening in a UC may need to be placed over a VC prior to attaching a storage component to a VC. In either embodiment a UC may be movable up (toward the underside of the deck) and down (away from the underside of the deck) on a VC. When the components of the apparatus are in place, the user may move a UC upward to the underside of the decking. Upward pressure of a UC may tightly associate the UC, the intervening planking and the AC. In the figure on the left, the UC may be secured in position via a screw securing mechanism (SSM) (190). The user may turn the SSM which may advance an element into contact with a VC thus preventing the UC from moving away from the underside of the deck plank (100). In the figure on the right of the figure, the UC may be secured on position via a lever securing mechanism (LSM) (195). For clarity, the figure shows an LSM oriented upward. However, in the functional version of the apparatus the LSM may be oriented and positioned in manner similar to the SSM. The user may deploy the LSM toward or away from the apparatus which may advance a dynamic bumper (DB) (200) into contact with a VC thus preventing the UC from moving away from the underside of the deck plank (100). A UC may be secured to the underside of the deck planking (100) via screws (holes visible on UC on right). Bumpers (205) may be utilized on a UC at the surface that may interact with the underside of the decking.

Figure 13:
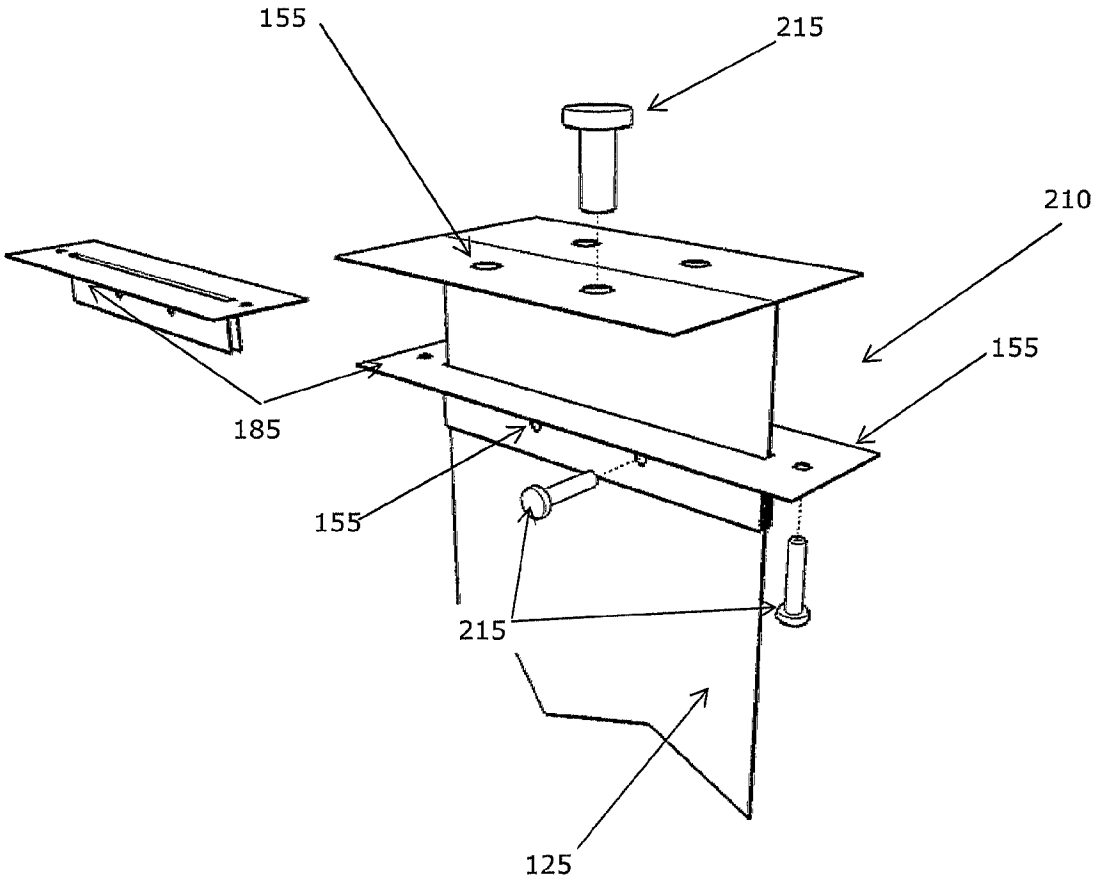
FIG. 13 is a perspective view of a deck securement mechanism according to a second embodiment.

FIG. 13 depicts another embodiment of mechanisms that may be utilized to create a more secure interaction between the deck and the apparatus. The figure on the left shows an underside component (UC) (185). The figure on the right shows a UC that has been placed on a vertical component (VC) (125). The UC may be assembled on the VC. Alternatively, a UC may be placed onto an end of a VC via the central opening. For clarity, no decking planks are shown in the figure. The planking may be in the area labeled as decking space (DS) (210). Screw holes are shown on the various components of the apparatus including the anchoring component and the underside component with screws or bolts (215). The number and location of the screw holes may be variable and may be positioned to optimize functionality.

Figure 14:
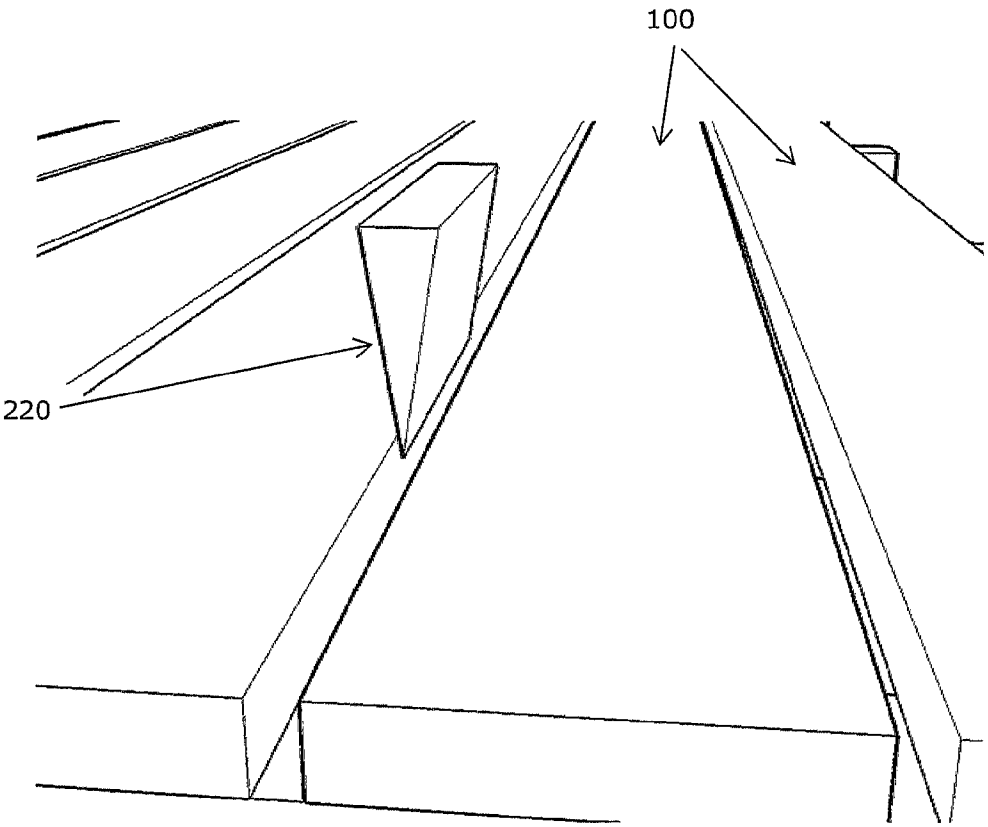
FIG. 14 is a perspective view of a deck spacing component.

FIG. 14 depicts an embodiment of a component that may be utilized to facilitate the placement of a vertical component between the decking planks. Decking planks (100) are shown in the figure. It is anticipated that the space between planks (100) may not be of a sufficient dimension to allow for the placement of a vertical component between. It thus may be necessary to modify the space to accommodate the placement of a VC. In the figure, a spacer (220) is shown as being placed in the space between two planks (100). A spacer may be designed various shapes and sizes. In one embodiment, a spacer is a triangular wedge-like element. The narrow end may be placed into a narrow space between two planks (100). As the spacer is advanced between the planks (100) a wider part of the spacer is advanced between the planks (100) thus widening the space. In the figure, the wide and flat top of the spacer may facilitate the use of a hammer or similar tool to assist in advancing the spacer.

Figure 15:
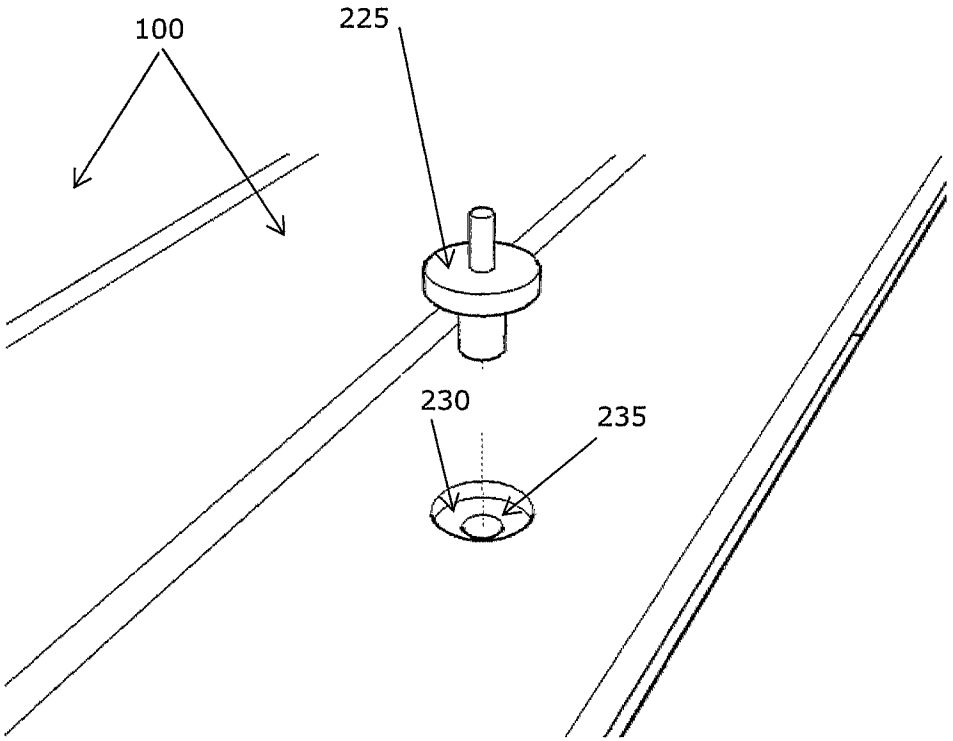
FIG. 15 is a perspective view of a drill bit for creating a beveled hole in decking.

FIG. 15 depicts a component of the apparatus that may allow for the modification of the decking to accommodate a specialized anchoring component. In the figure, deck planks (100) are visible. A specialized drill bit (SDB) (225) may allow the user to create a customized opening on a deck plank (100). An SDB may be designed to fit any standard commercial drill. The customized opening may include a partial thickness opening that may create a bevel (230). This may provide a surface on which an anchoring component may rest. Within the partial thickness opening may be a hole (235) that passes through the remainder of the plank (100). This may allow a vertical component to pass through the space below where it may be attached to a storage component.

Figure 16:
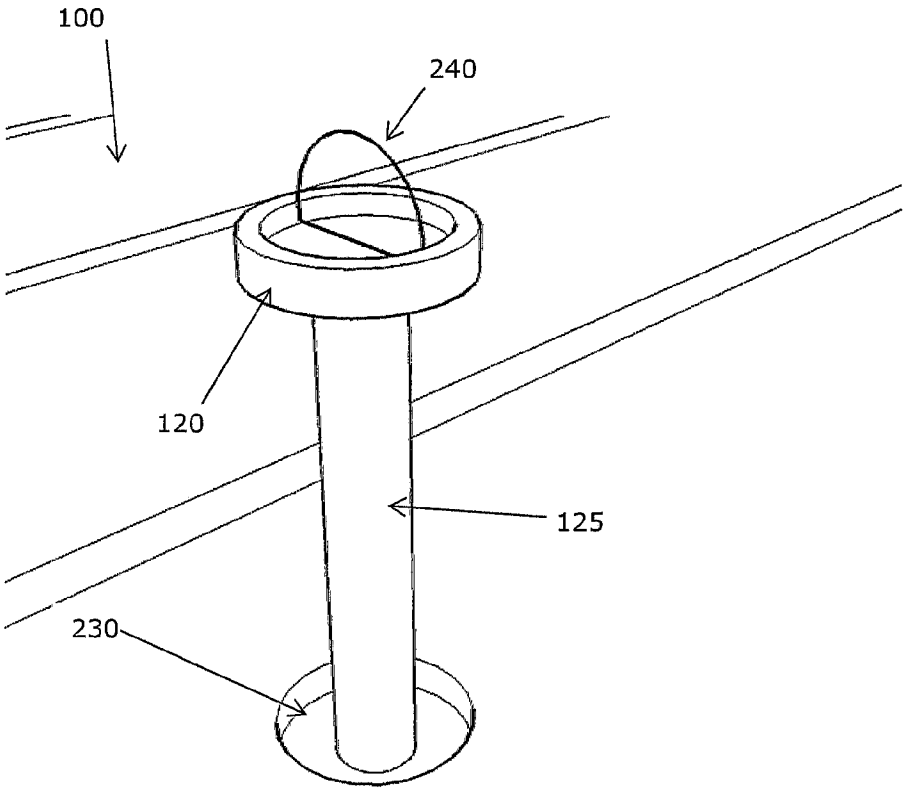
FIG. 16 is a perspective view of an anchoring component for use with the beveled hole of FIG. 15.

FIG. 16 depicts an embodiment of an anchoring and vertical component designed to pass through a customized hole in a deck plank (100). The figure shows decking planks (100). A specialize anchoring component (AC) (120) and vertical component (VC) (125) are shown. In one embodiment, the AC and the VC may be integrated as a single unit. Alternatively, an AC and a VC may be separate components that may be assembled at the time of need. The AC in this embodiment may be constructed with a handle (240). The handle may be constructed with swivel functionality. This may allow the handle to be placed into a recessed area of the AC allowing the AC to maintain a flat profile. In the figure, the VC passes through the previously described hole to the space below the deck. The anchoring component may rest on the bevel (230).

Figure 17:
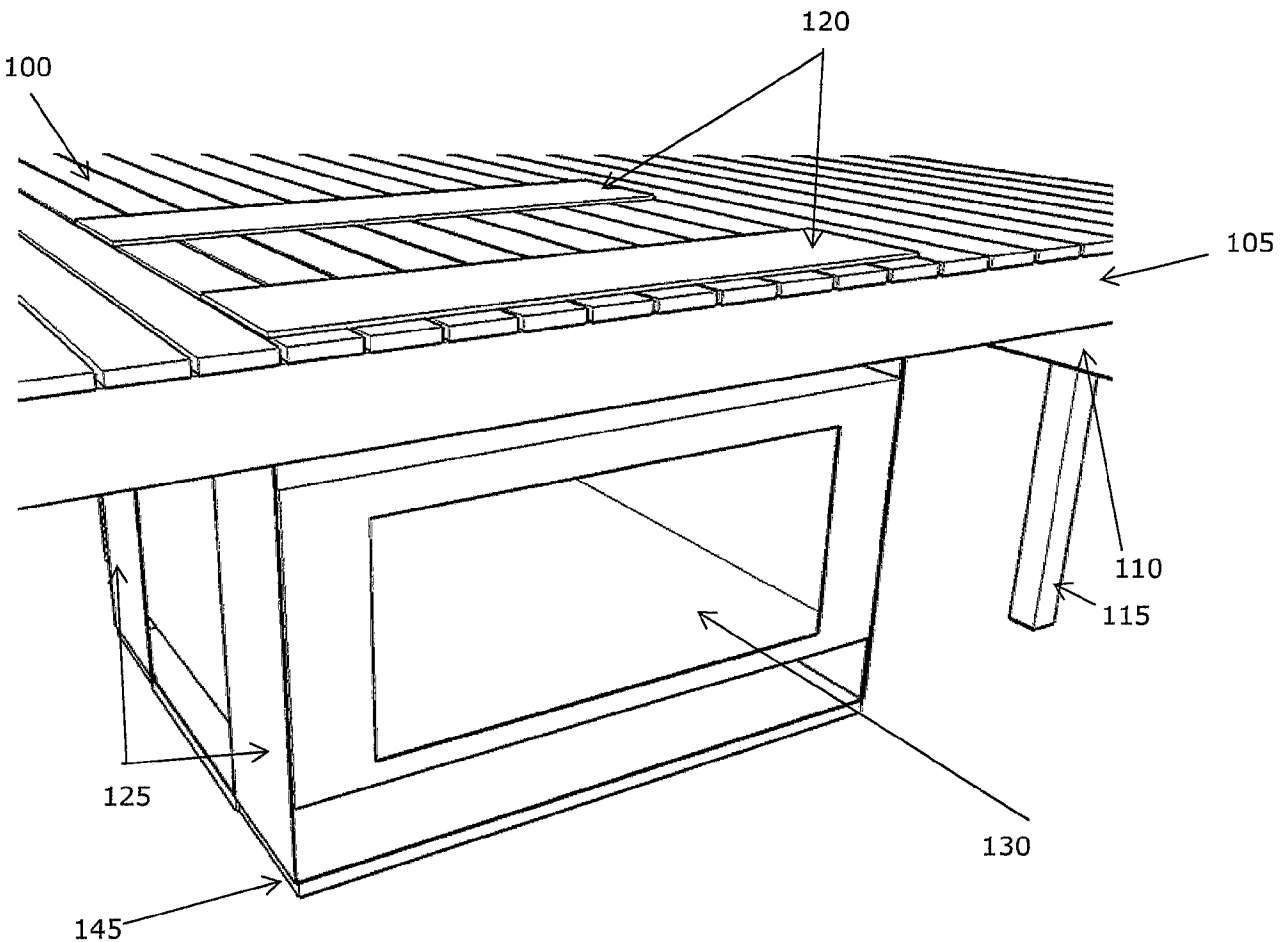
FIG. 17 is a perspective view of a deck anchoring apparatus according to a fifth embodiment.

FIG. 17 depicts an embodiment of the apparatus that may include anchoring components that span multiple deck planks (100). In the figure, the components of the deck are shown to include the planks (100), a joist (105), a beam (110) and a post (115). In the figure, the anchoring component (AC) (120) is shown as an element that spans multiple decking planks (100). In this embodiment an AC may include a rigid or non-rigid element that may rest on the top of multiple decking planks (100). At either end the AC may interact with vertical components (VC) (125). The AC and VCs may be a single element that may be placed on the deck as a single unit. Alternatively, the AC and VCs may be assembled by the user at the time of need. In one embodiment, this assembly may occur via a solid cylinder that extends parallel to the edge of one end one of the components that may be inserted into a hollow partial circumferential tube. The solid cylinder may be positioned on an extender that may be designed to project the cylinder away from the component. The hollow tube may also be positioned on an extender similar to the cylinder. The partial circumferential design of the tube may allow align with the extender of the extender of the cylinder thus allowing the tube to slide freely over the cylinder. The design may provide a hinge-like action. In the figure, the VCs are shown as interacting with a sliding platform (145). On the sliding platform a storage component (130) has been placed.

Figure 18:
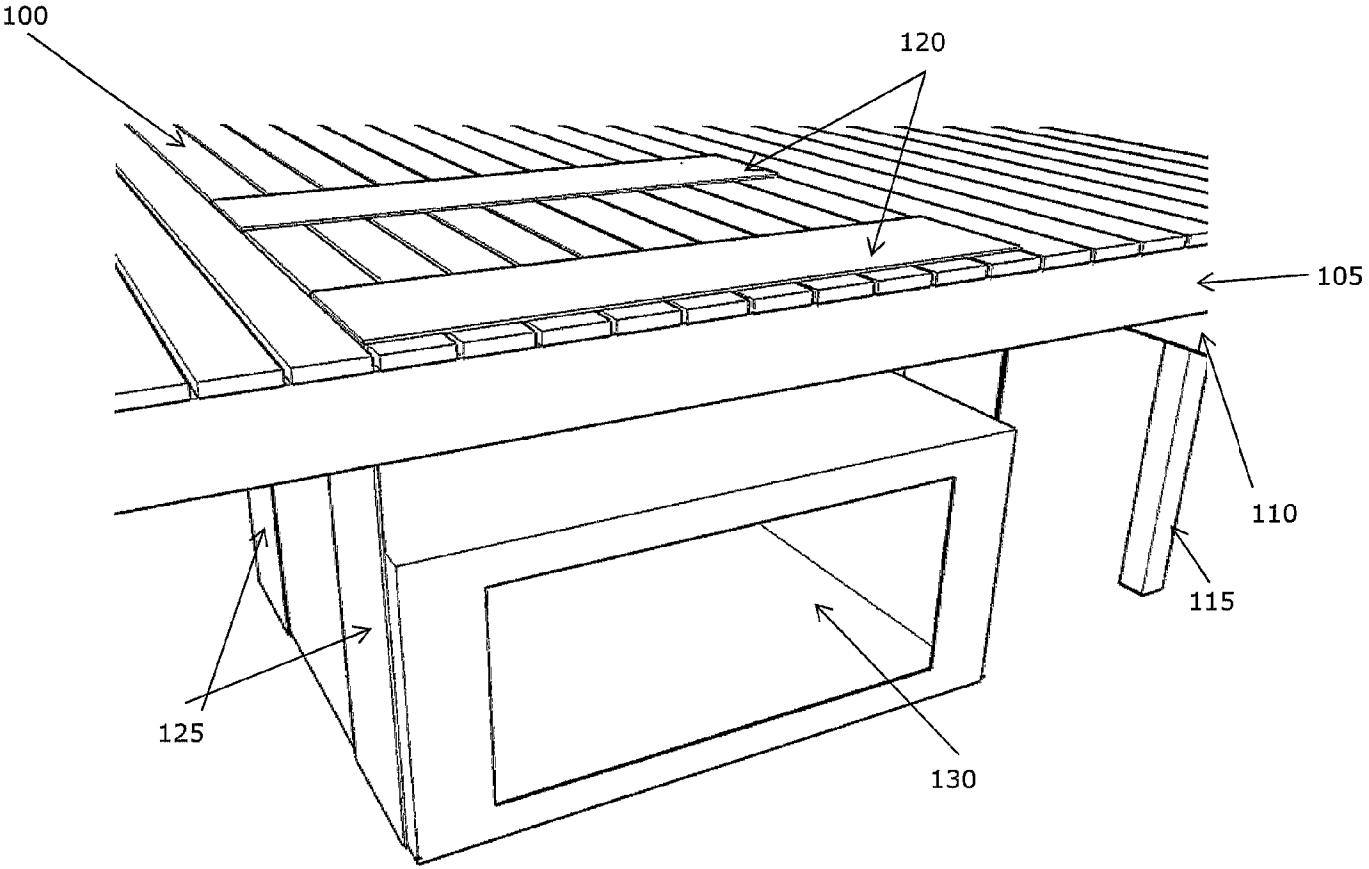
FIG. 18 is a perspective view of a deck anchoring apparatus according to a sixth embodiment.

FIG. 18 depicts an embodiment of the apparatus that may include anchoring components that span multiple deck planks (100). In the figure, the components of the deck are shown to include the planks (100), a joist (105), a beam (110) and a post (115). In the figure, the anchoring component (AC) (120) is shown as an element that spans multiple decking planks (100). In this embodiment an AC may include a rigid or non-rigid element that may rest on the top of multiple decking planks (100). At either end the AC may interact with vertical components (VC) (125). The AC and VCs may be a single element that may be placed on the deck as a single unit. Alternatively, the AC and VCs may be assembled by the user at the time of need. In one embodiment, this assembly may occur via a solid cylinder that extends parallel to the edge of one end one of the components that may be inserted into a hollow partial circumferential tube. The solid cylinder may be positioned on an extender that may be designed to project the cylinder away from the component. The hollow tube may also be positioned on an extender similar to the cylinder. The partial circumferential design of the tube may allow align with the extender of the extender of the cylinder thus allowing the tube to slide freely over the cylinder. The design may provide a hinge-like action. In the figure, the VCs are shown as interacting with a storage component (130).

Figure 19:
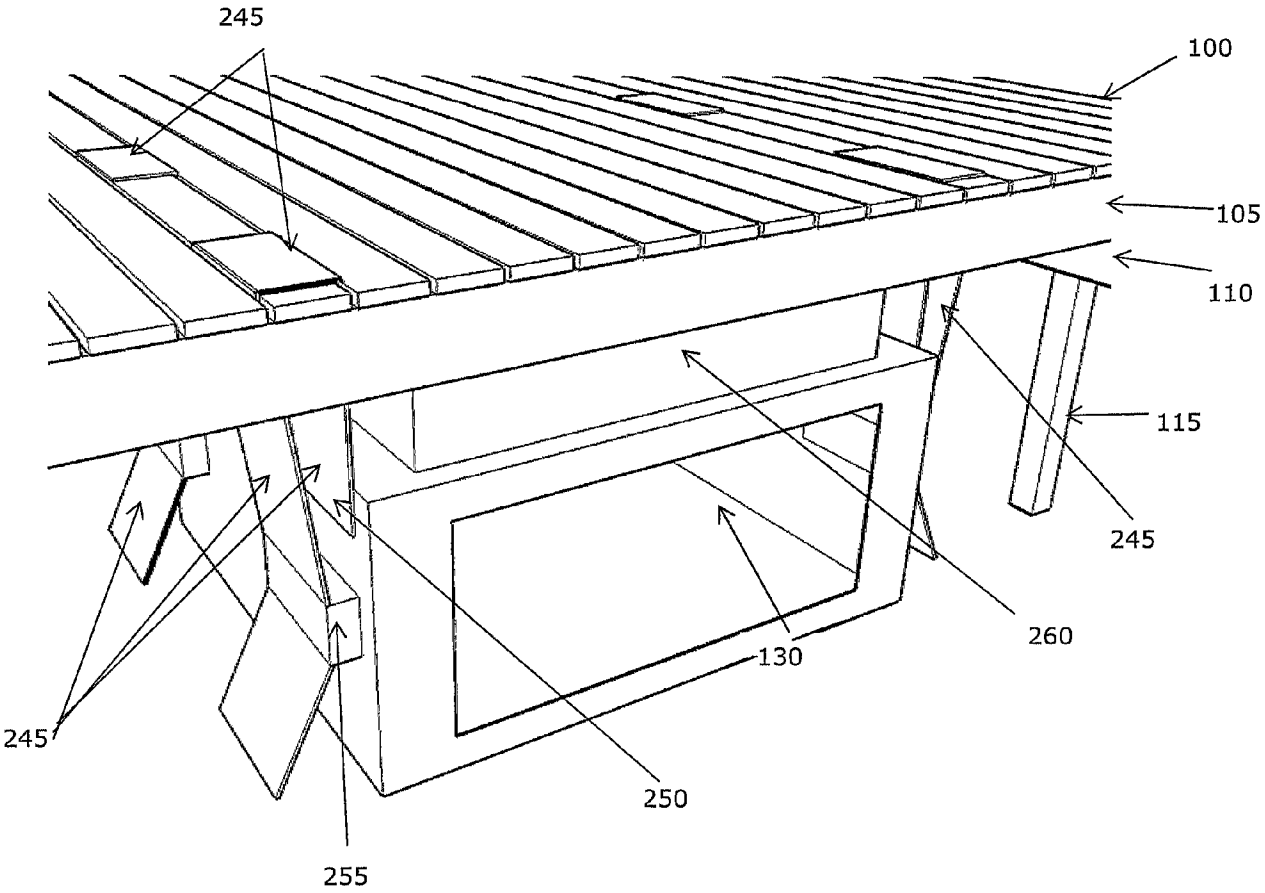
FIG. 19 is a perspective view of a deck anchoring apparatus according to a seventh embodiment.

FIG. 19 depicts an embodiment of the apparatus that utilizes a belt-like element that functions as both an anchoring component and a vertical component. In the figure, the components of the deck are shown to include the planks (100), a joist (105), a beam (110) and a post (115). The belt-like combined anchoring vertical component (BCAVC) (245) is shown as interacting with the storage component (SC) (130) at one position, extending upward through the space between two decking planks (100), over a plank (100), and back down below the deck to again interact with the SC. The BCAVC may allow the user to raise and lower an SC toward and away from the undersurface of the deck. A BCAVC may interact with an SC in various designs. In one embodiment an SC may be constructed with one end of a BCAVC integrated (250) at the time of construction. The other end of the BCAVC may of necessity be free so that it may be positioned through the deck plank spaces and then be secured (255) to an SC at a different location. This second point of interaction with an SC may be detachable allowing the user to move an SC as previously described. One possible mechanism of this second attachment may be a simple mechanism such as a belt buckle. Alternatively, a BCAVC may need to be attached to an SC prior to use at the point shown (250). In that the user may be able to raise and lower the SC it may be necessary to limit the movement of an SC. In the figure, a spacing element (260) is shown. This spacing element may be a part of an SC or it may be secured to the underside of the deck.

Figure 20:
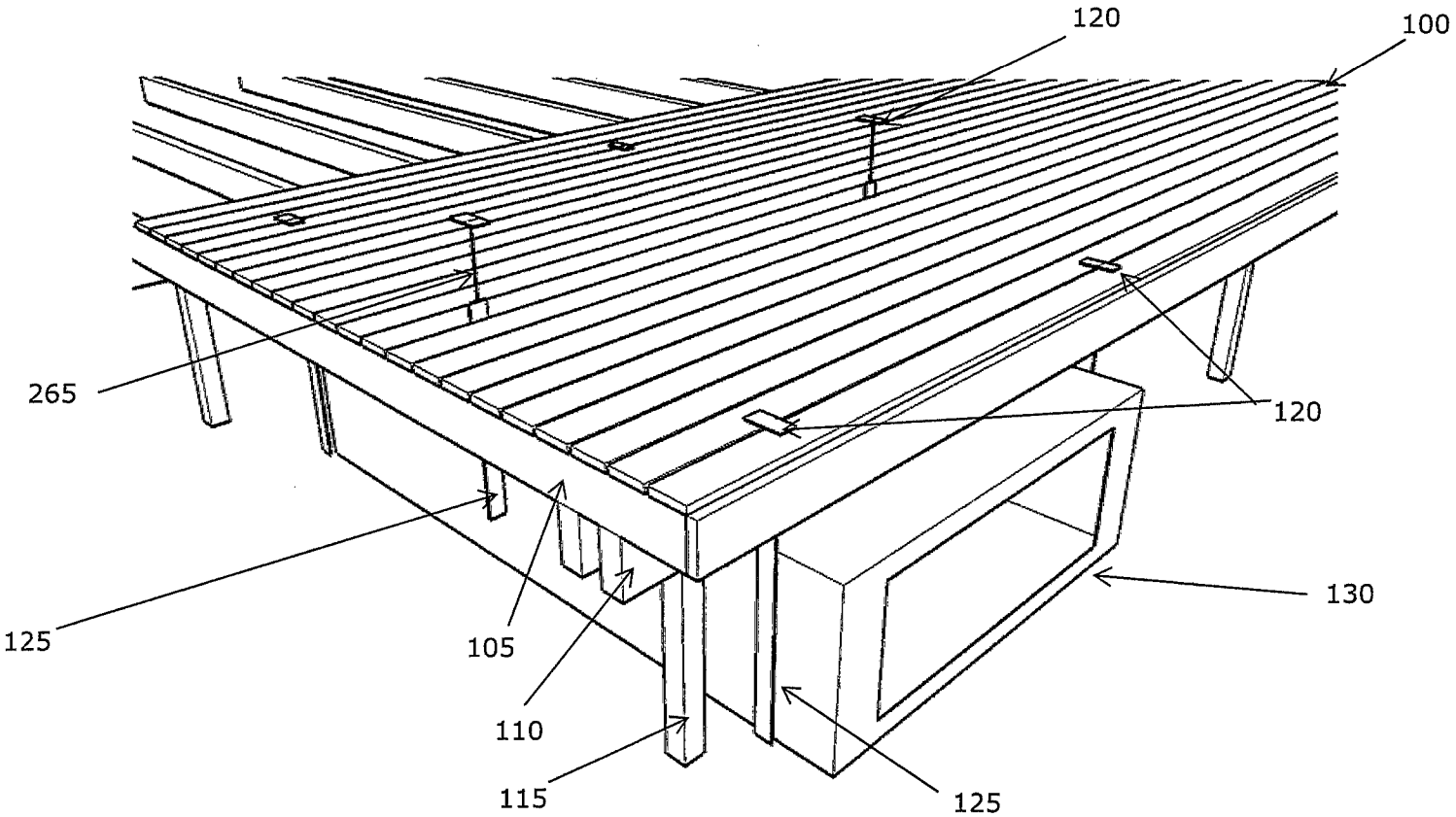
FIG. 20 is a perspective view of a deck anchoring apparatus according to a seventh embodiment.

FIG. 20 depicts an embodiment of the apparatus in which specialized components are utilized to facilitate a storage component to be oriented perpendicular to the decking planks (100). In the figure, the components of the deck are shown to include the planks (100), a joist (105), a beam (110) and a post (115). Anchoring components (AC) are shown in the figure, as well as vertical components (VC). A specialized anchoring-vertical adapting element (AVAE) (265) is shown interpositioned between an AC and a VC. In one embodiment of the apparatus, an AC, AVAE and VC may be constructed as a single unit. In this embodiment a VC may be placed through the space between two deck planks (100). The AVAE may then allow a VC to rotate so that the flat aspect of a VC may be facing a storage component (SC) (130) thus allowing for more contact surface area. Alternatively, an AC, AVAE and a VC may be separate elements that need to be assembled at the time of use resulting in the same functionality.

Figure 21:
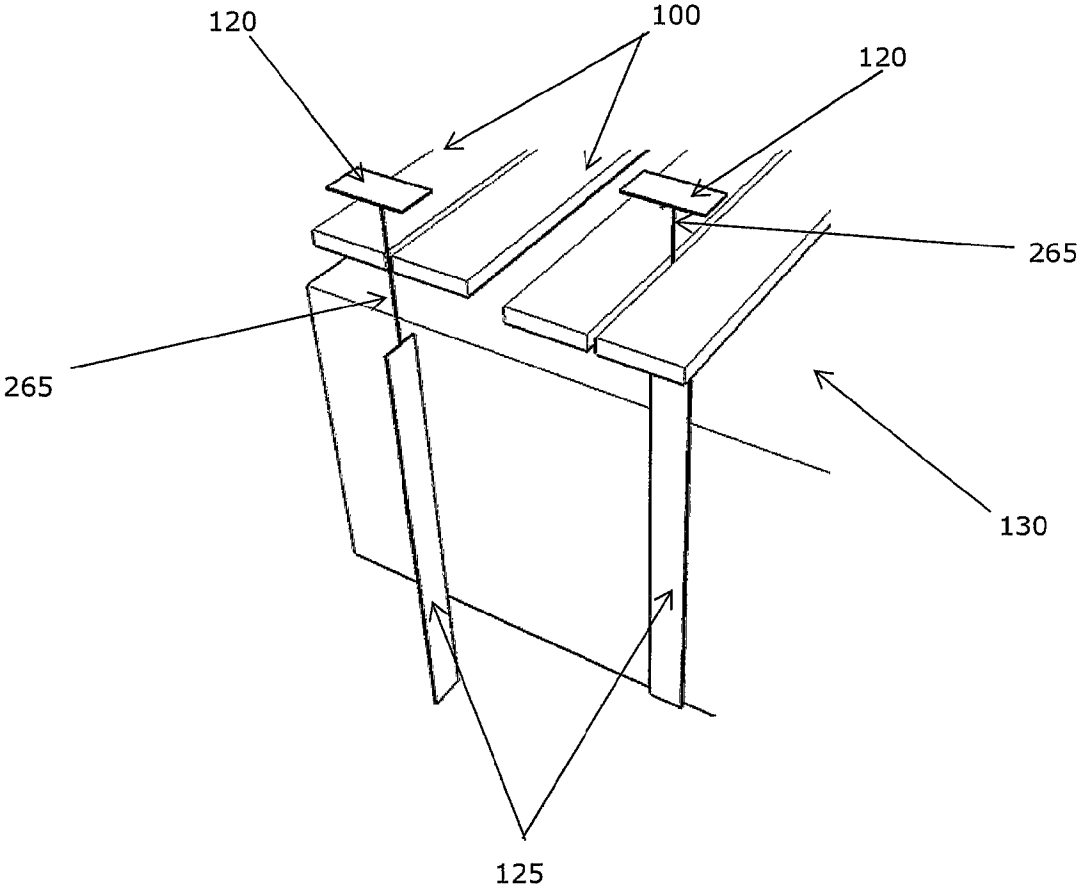
FIG. 21 is a perspective view of an adaptive anchoring element according to a first embodiment for use in the deck anchoring apparatus of FIG. 20.

FIG. 21 depicts an embodiment of the apparatus in which specialized components are utilized to facilitate a storage component to be oriented perpendicular to the decking planks (100). This figure is essentially a closer view of the components shown in FIG. 20. Anchoring components (AC) are shown in the figure, as well as vertical components (VC). A specialized anchoring-vertical adapting element (AVAE) (265) is shown inter-positioned between an AC and a VC. In one embodiment of the apparatus, an AC, AVAE and VC may be constructed as a single unit. In this embodiment, a VC may be placed through the space between two deck planks (100). The AVAE may then allow a VC to rotate so that the flat aspect of a VC may be facing a storage component (SC) (130) thus allowing for more contact surface area. Alternatively, an AC, AVAE and a VC may be separate elements that need to be assembled at the time of use resulting in the same functionality.

Figure 22:
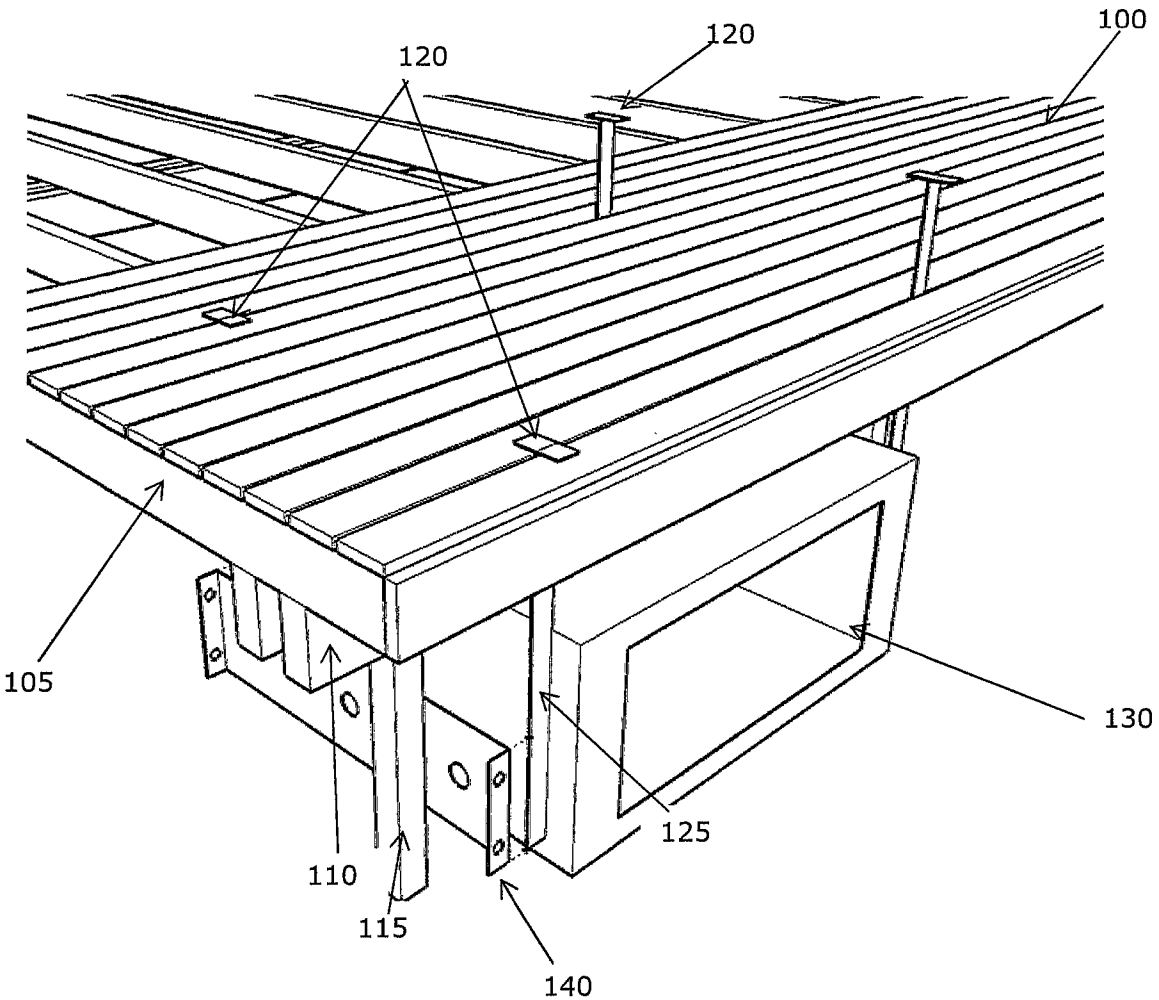
FIG. 22 is a perspective view of a deck anchoring apparatus according to an eighth embodiment.

FIG. 22 depicts an embodiment of the apparatus that facilitates the orientation of a storage component perpendicular to the decking planks (100). In the figure, the components of the deck are shown to include the planks (100), a joist (105), a beam (110) and a post (115). Two vertical components (VC) (125) are shown as interacting with anchoring components (AC) (120) that are in place on the decking planks (100). Under the deck, a horizontal attachment component (HAC) (140) is shown. The HAC is constructed with two elements that may allow the HAC to interact with VCs. This interaction may be carried out via various mechanisms. In one embodiment, elements of an HAC are constructed that may be oriented to provide a surface area that may be parallel to a VC and allow for an interaction with the VC. The interaction between an HAC and a VC may be secured via bolts that may be utilized via the visible holes. An HAC may then provide a longitudinal structure providing more area for interaction with a storage component (SC) (130) that may be available via VCs.

Figure 23:
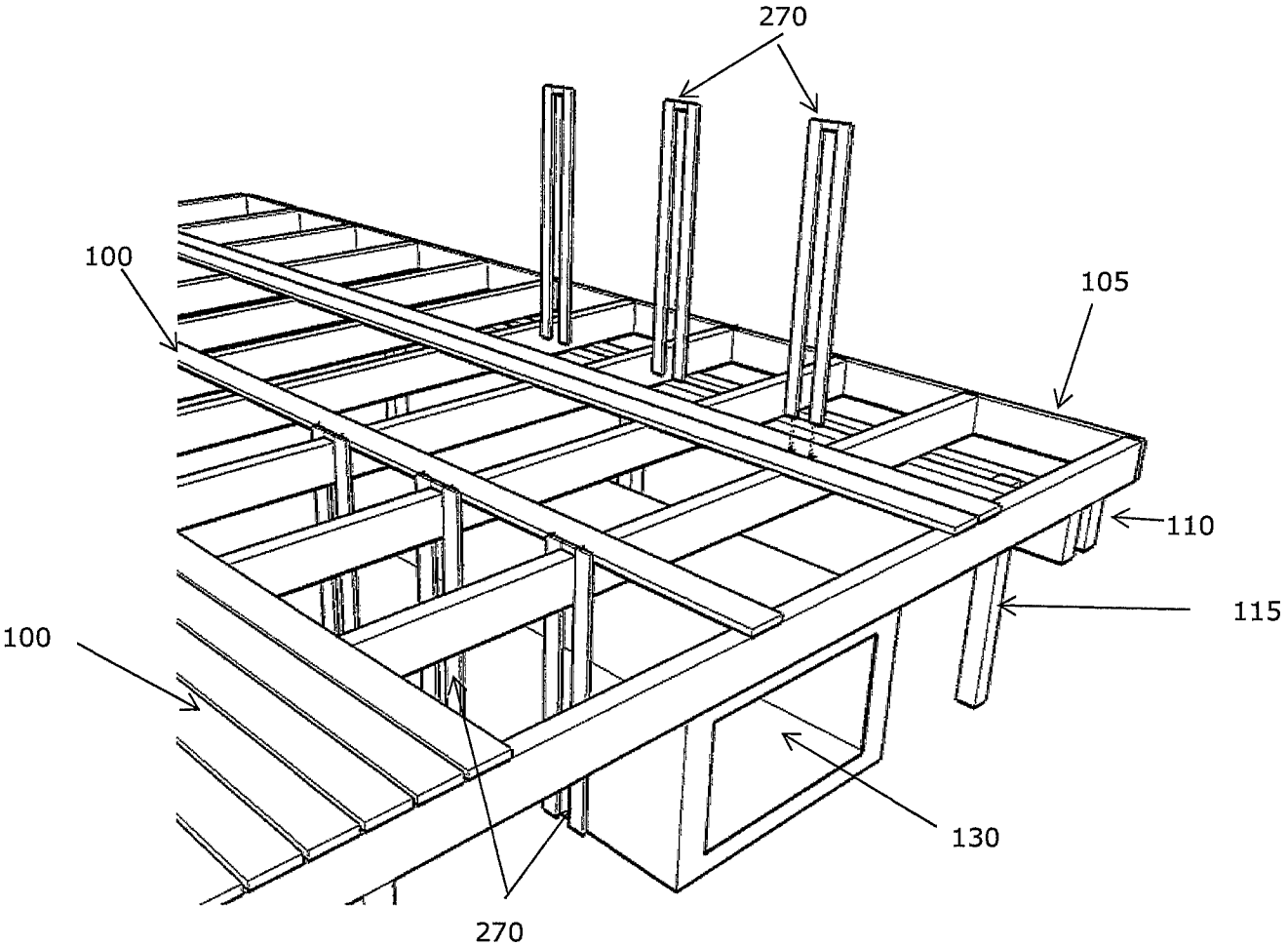
FIG. 23 is a perspective view of a deck anchoring apparatus according to a ninth embodiment.

FIG. 23 depicts an embodiment of the apparatus in which the anchoring components are placed on the joists. In the figure, the components of the deck are shown to include the planks (100), a joist (105), a beam (110) and a post (115). Joist anchoring components (JAC) (270) are shown in the figure. The three JACs in the back of the figure are positioned above the space between two decking planks (100). In the foreground the JACs have been positioned to rest on the joists. The limbs of a JAC that project below the deck may then provide a mechanism of interaction with a storage component (SC) (130).

Figure 24:
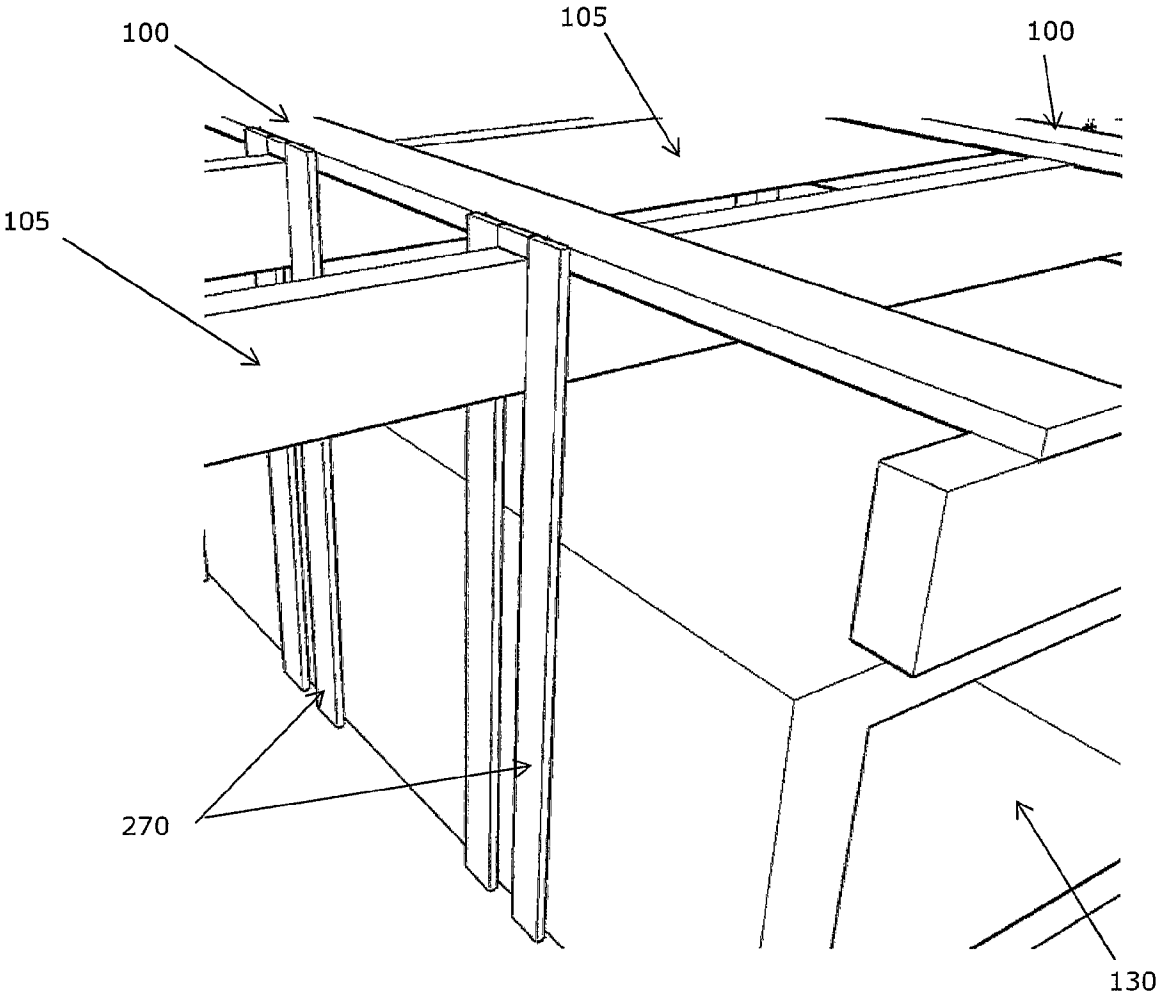
FIG. 24 is blown-up perspective view of the deck anchoring apparatus of FIG. 23.

FIG. 24 depicts an embodiment of the apparatus in which the anchoring components are placed on the joists. This figure essentially shows a closer view of the components of FIG. 23. In the figure, the components of the deck are shown to include the planks (100) and joists (105). For clarity, the majority of the decking planks are not shown. Joist anchoring components (JAC) (270) are shown in the figure. The limbs of the JACS have been place into the space between two deck planks (100) and advanced to the space below the deck thus bringing the horizontal element of the JACs to contact the joists. The JAC may be secured to a joist or decking planks (100) utilizing screws or various clamps. The limbs of the JACs below the deck may the serve to provide a point of attachment for a storage component (SC) (130).

Figure 25:
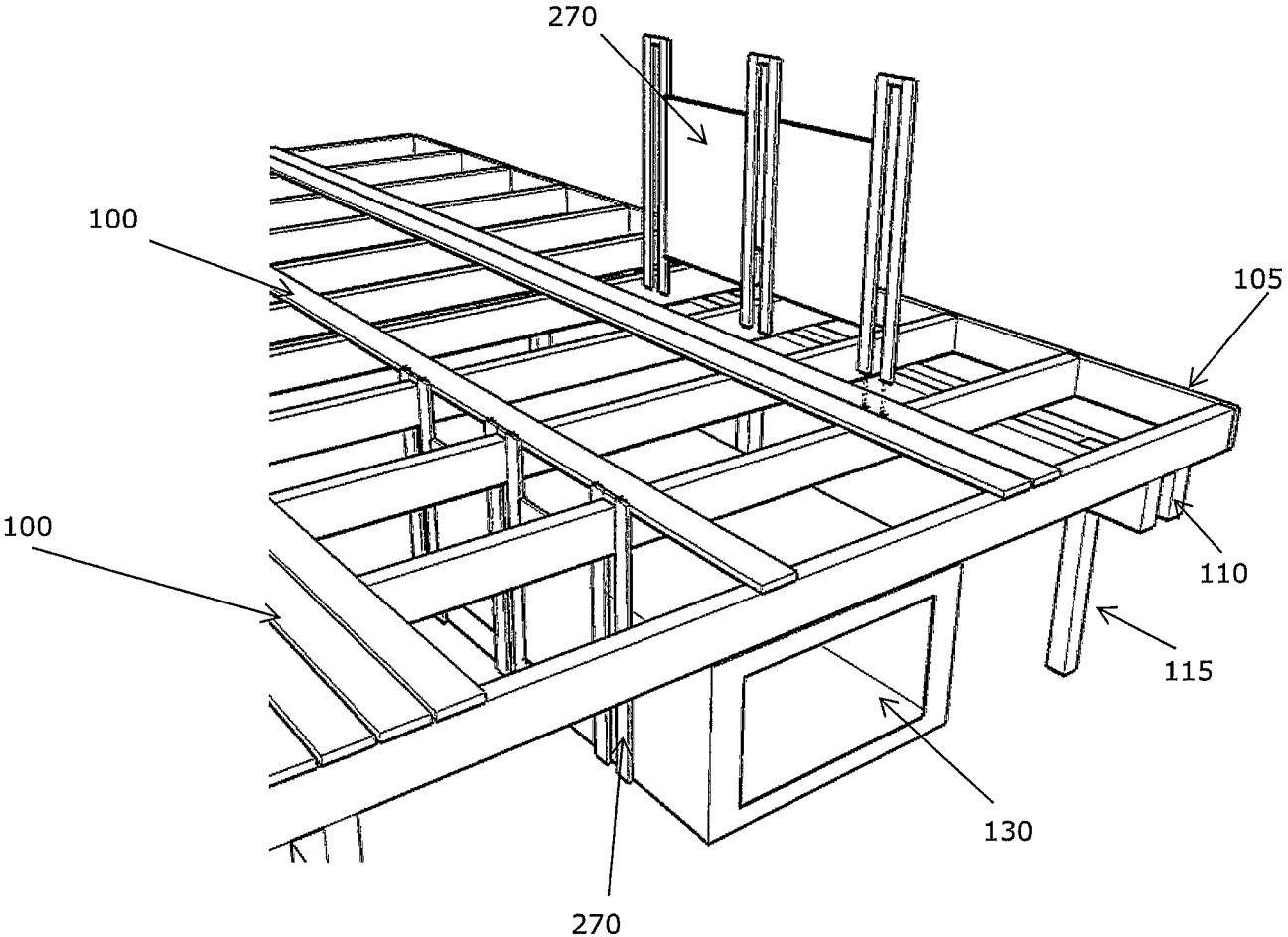
FIG. 25 is a perspective view of a deck anchoring apparatus according to a tenth embodiment.

FIG. 25 depicts an embodiment of the apparatus in which the anchoring components are placed on the joists. In the figure, the components of the deck are shown to include the planks (100), a joist (105), a beam (110) and a post (115). For clarity, the majority of the decking planks are not shown. Joist anchoring components (JAC) (270) are shown in the figure. In this embodiment a JAC may include a series of previously described elements that have been integrated into a component that may interact with multiple joists. On the right in the figure, the JAC is situated above the deck. On the left of the figure, the limbs of the JACS have been place into the space between two deck planks (100) and advanced to the space below the deck thus bringing the horizontal element of the JACs to contact the joists. The JAC may be secured to a joist or decking planks (100) utilizing screws or various clamps. The limbs of the JACs below the deck may the serve to provide a point of attachment for a storage component (SC) (130).

Figure 26:
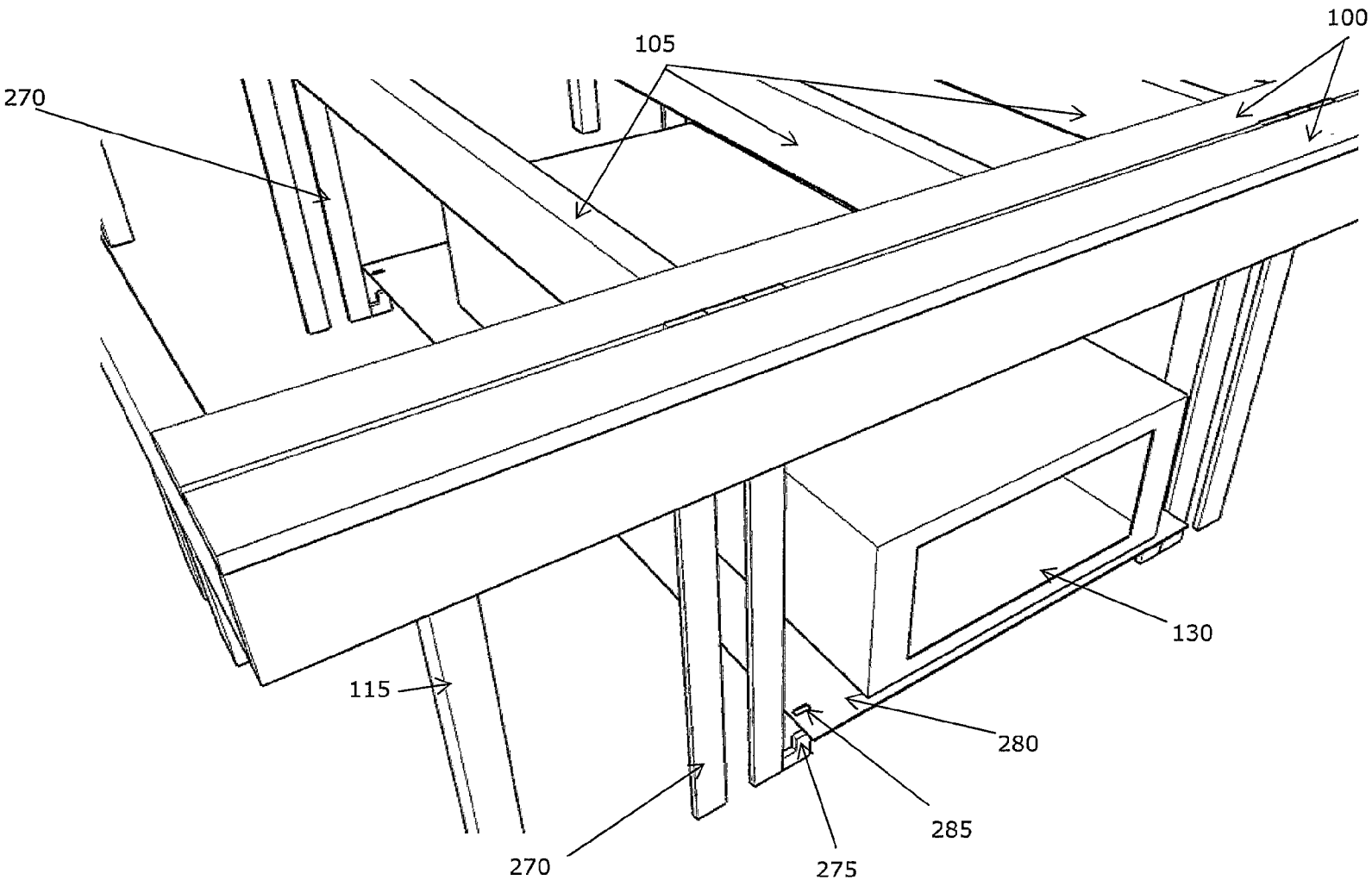
FIG. 26 is a perspective view of a deck anchoring apparatus according to an eleventh embodiment.

FIG. 26 depicts an embodiment of the apparatus in which the anchoring components are placed on the joists. In the figure, the components of the deck are shown to include the planks (100), a joist (105) and a post (115). For clarity, the majority of the decking planks are not shown. Joist anchoring components (JAC) (270) are shown in the figure. In the figure, a storage component (SC) (130) is shown as resting on a platform (280) that has been constructed with holes (285). The storage component in the figure is oriented perpendicular to the deck planking (100). This is achieved by having the SC interact with the narrower edge of the JAC rather than a SC interacting with the broader aspect of a JAC. In the figure, the JAC is constructed with posts (275) on which a platform, and thus an SC, may be placed.

Figure 27:
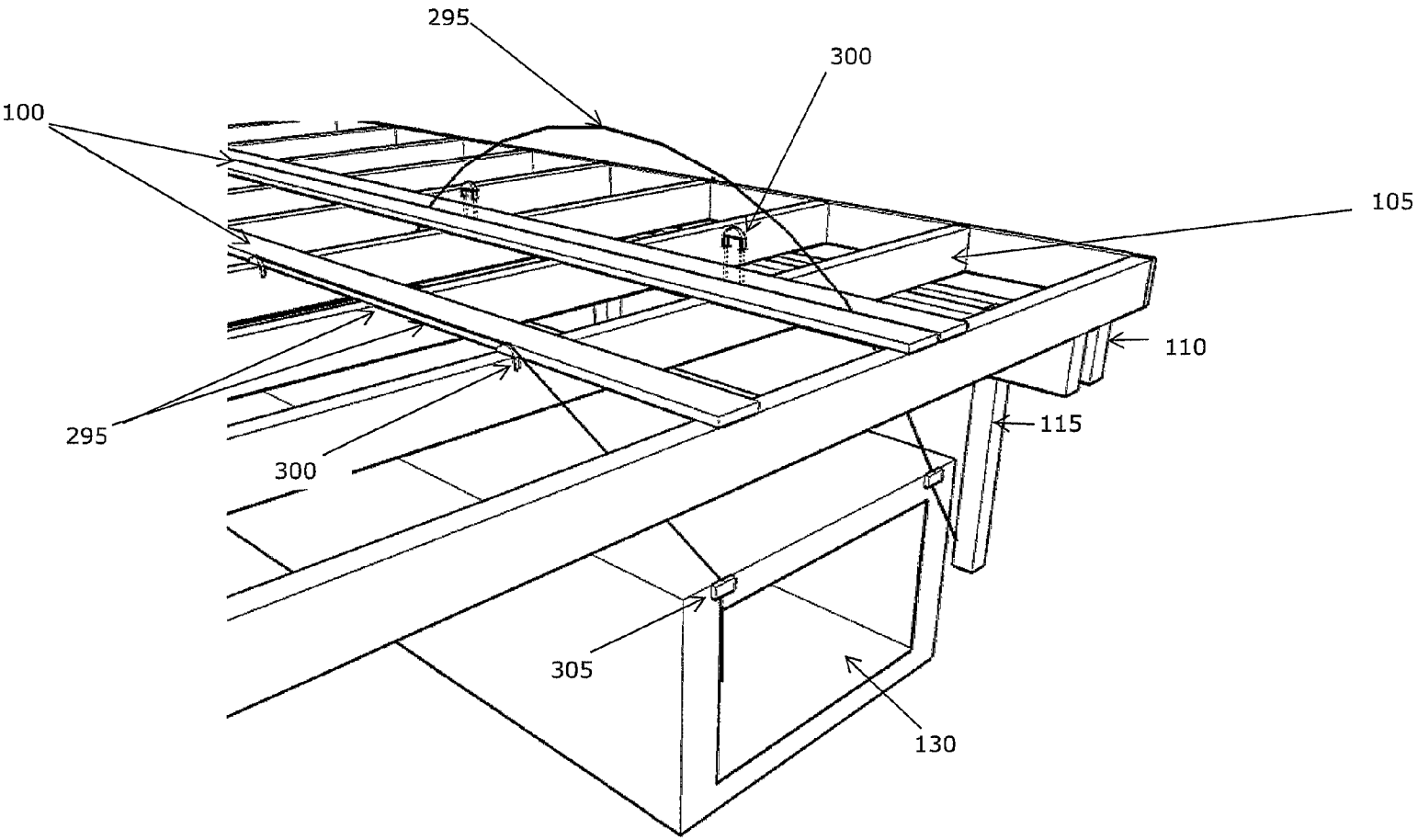
FIG. 27 is a perspective view of a deck anchoring apparatus according to a twelfth embodiment.

FIG. 27 depicts an embodiment of the apparatus in which wire-like anchoring components are placed on the joists. In the figure, the components of the deck are shown to include the planks (100), a joist (105), a beam (110) and a post (115). A storage component (SC) (130) is positioned underneath the deck. Wire-like anchoring components (WLAC) (295) are shown. A WLAC may be utilized to suspend an SC from the deck. A WLAC may attach to one end of an SC, be positioned over one or more joists, and then re-attach to the SC. The attachment of a WLAC to an SC may be reversible at one end or both ends utilizing various mechanisms. An anchoring component guide (ACG) (300) may be positioned on the component of the deck where the WLAC rests. In the figure, the WLAC toward the right is shown in position over ACGs and joists and in between two decking planks (100) before being secured. The WLAC toward the left has been secured tightly so that the WLAC is resting on ACGs which in turn have been positioned on joists. In this arrangement the WLAC may rest below the decking within the space between two decking planks (100). A WLAC may allow the user to control the distance of an SC from the deck. This distance may A WLAC may be utilized to suspend the apparatus from other elements of a deck. It is envisioned that a WLAC may rest on the decking planks (100). In this embodiment grooves, perpendicular to the long axis of the decking planks (100), may be created in the planks to allow a WLAC to be positioned below the top surface of the decking.

Figure 28:
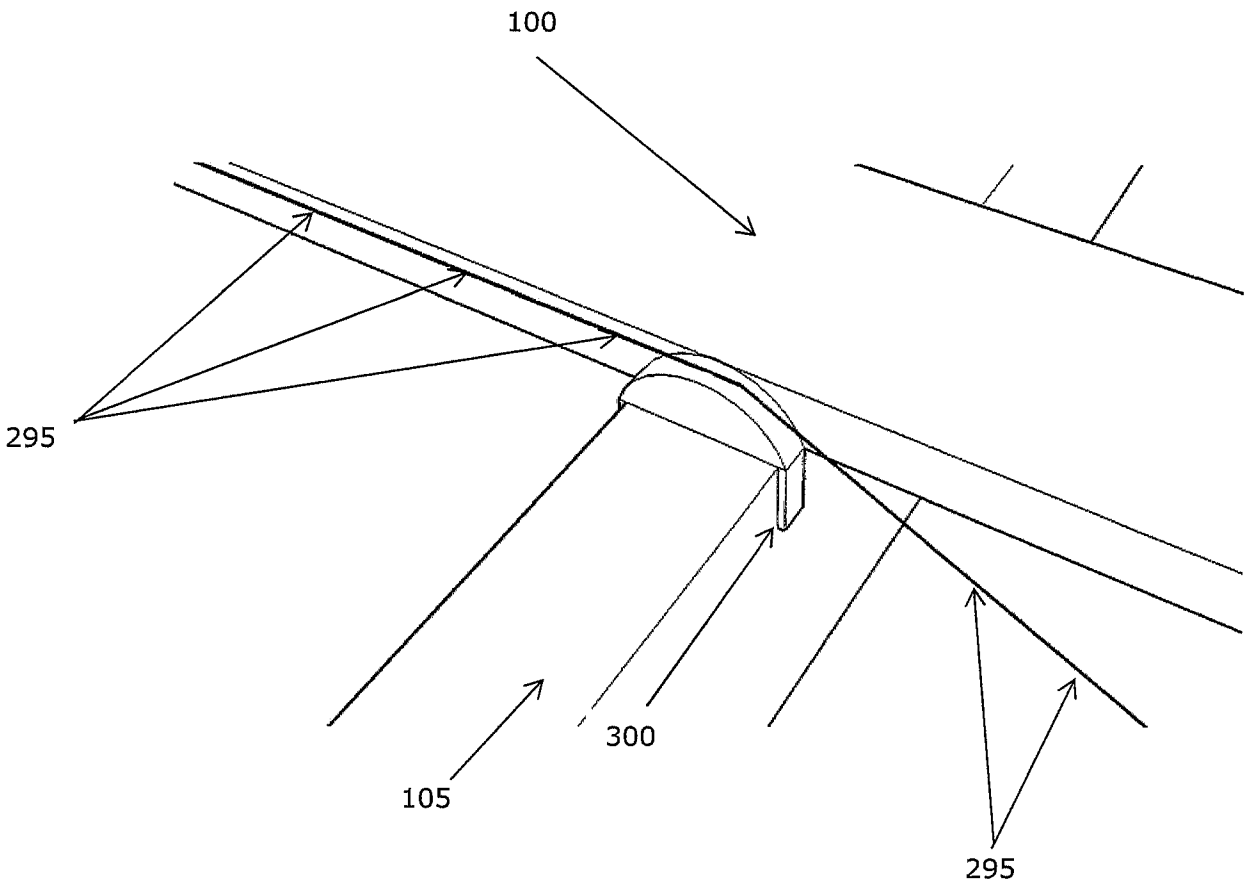
FIG. 28 is a blown-up perspective view of the deck anchoring apparatus of FIG. 27.

FIG. 28 depicts an embodiment of the apparatus in which wire-like anchoring components are placed on the joists. In the figure, the components of the deck are shown to include the planks (100) and a joist (105). For clarity, only a single decking plank (100) is shown in the figure. A wire-like anchoring component (WLAC) (295) is shown as projecting just below the surface of a decking plan in the space between two planks (100). An anchoring component guide (ACG) (300) has been placed on a joist in the space between two planks (100). An ACG may be constructed to avoid contact of a WLAC with the edges of joist. An ACG may have a central groove to keep a WLAC aligned. In the figure, the ACG is curved. This embodiment may also assist in directing a WLAC to a position below the deck to interact with a storage component. An ACG may be secured to a joist with screws.

Figure 29:
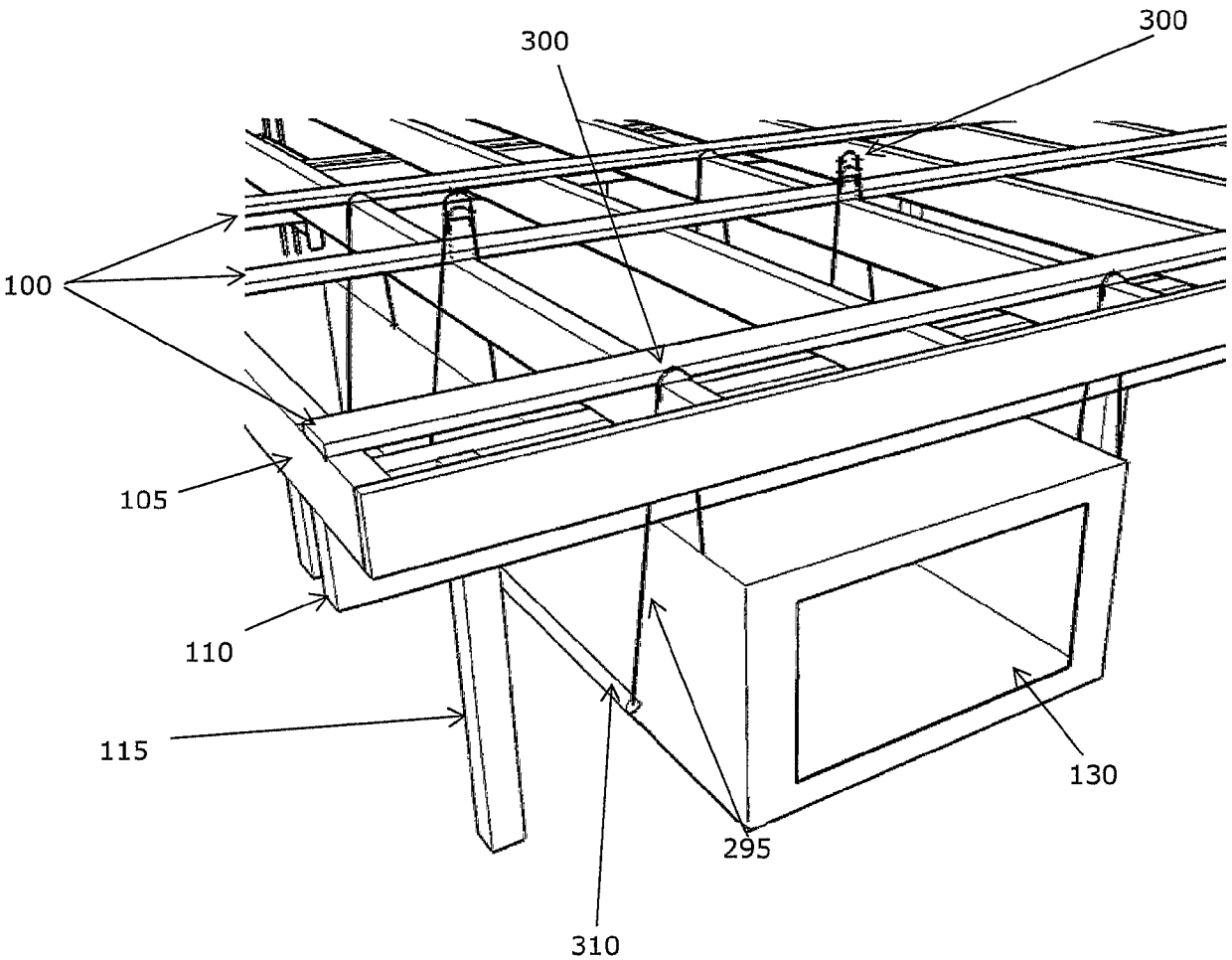
FIG. 29 is a perspective view of a deck anchoring apparatus according to a thirteenth embodiment.

FIG. 29 depicts an embodiment of the apparatus in which wire-like anchoring components are placed on the joists. In the figure, the components of the deck are shown to include the planks (100), a joist (105), a beam (110) and a post (115). A storage component (SC) (130) is positioned underneath the deck. Wire-like anchoring components (WLAC) (295) are shown. A WLAC may be utilized to suspend an SC from the deck. A WLAC may attach to one end of an SC, be positioned over one or more joists, and then re-attach to the SC. The attachment of a WLAC to an SC may be reversible at one end or both ends utilizing various mechanisms. An anchoring component guide (ACG) (300) may be positioned on the component of the deck where the WLAC rests. In the figure, the SC is oriented perpendicular to the decking. A handle for the wire like anchoring component (HWLAC) (310) is shown. A HWLAC may allow a user to elevate and lower an SC. To secure an SC in a desired location, the HWLAC may attach either back on an SC or to another location on the deck.

Figure 30:
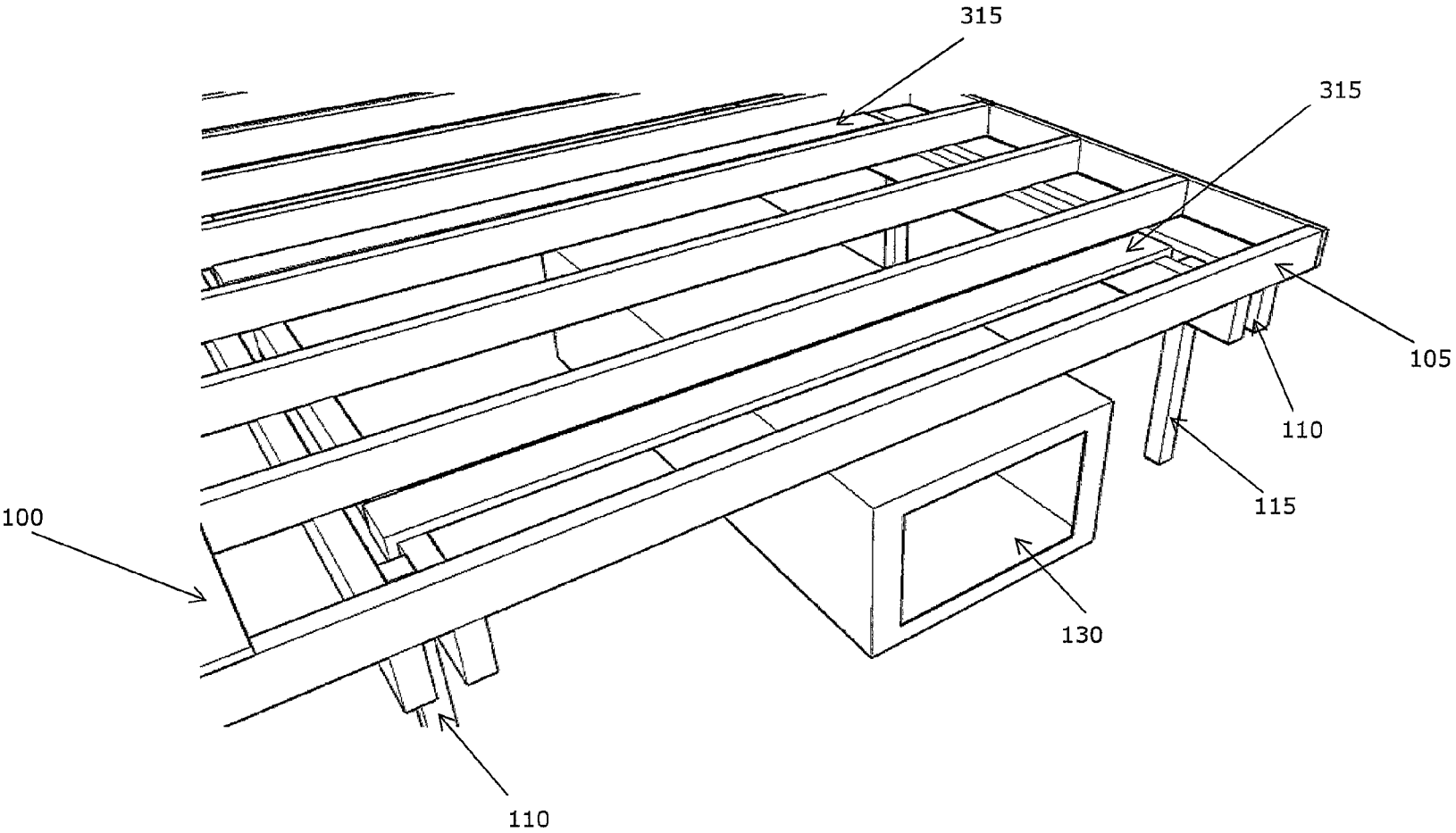
FIG. 30 is a perspective view of a deck anchoring apparatus according to a fourteenth embodiment.

FIG. 30 depicts an embodiment of the apparatus in which the anchoring components are placed on beams. In the figure, the components of the deck are shown to include the planks (100), a joist (105), a beam (110) and a post (115). A storage component (SC) (130) is positioned underneath the deck. In this embodiment of the apparatus an SC is suspended from the deck utilizing a beam anchoring component (BAC) (315). A BAC may include a horizontal element that may span two or more beams. On each end of the horizontal element a BAC may have vertical elements that may be positioned on the side of a beam. The horizontal element of a BAC may be constructed with a telescoping feature so that the length of a BAC may be adjusted by the user. Various mechanisms may be utilized to attach an SC to a BAC.

Figure 31:
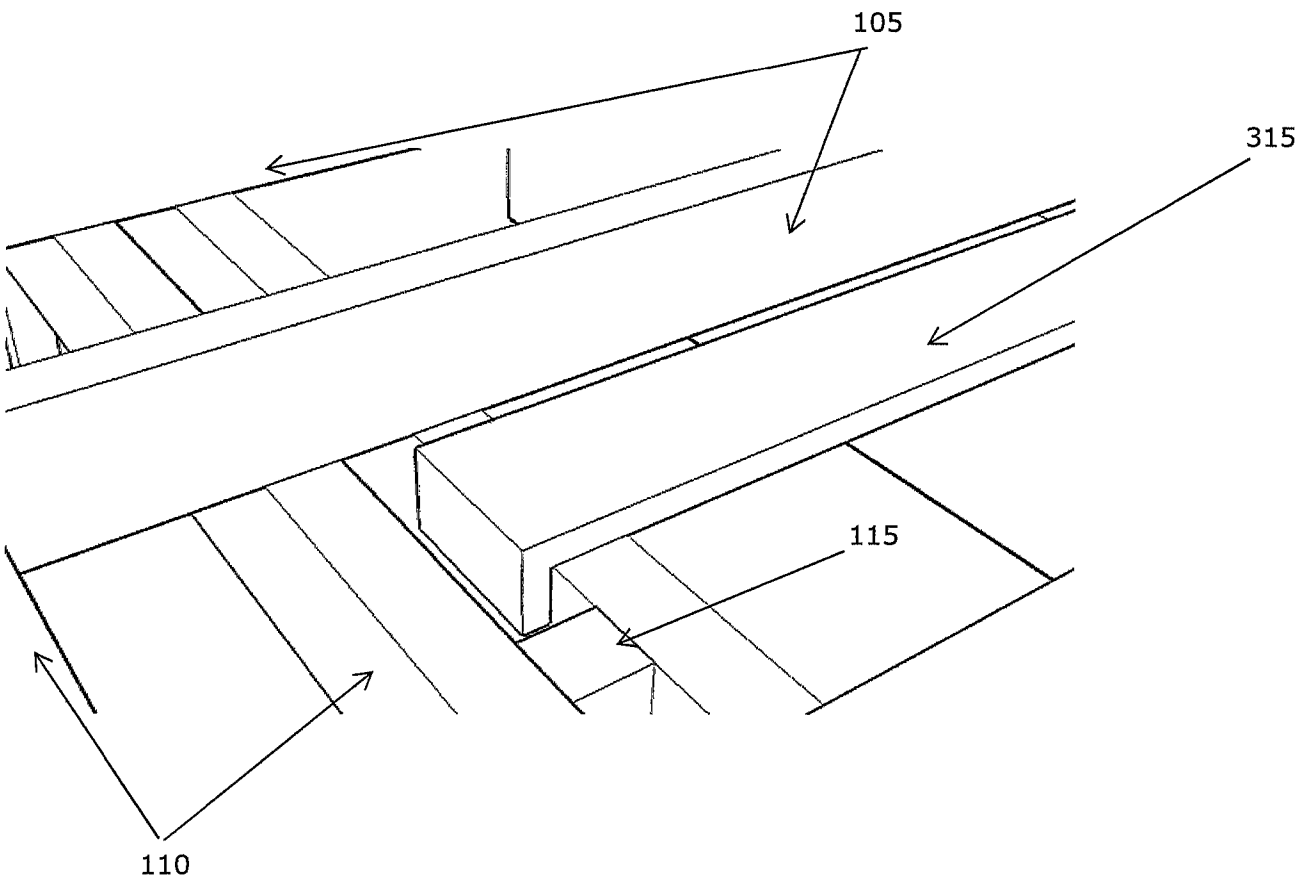
FIG. 31 is a blown-up perspective view of the deck anchoring apparatus of FIG. 30.

FIG. 31 depicts an embodiment of the apparatus in which the anchoring components are placed on beams. In the figure, the components of the deck are shown to including joists (105), beams (110) and a post (115). A BAC is shown to include the horizontal element and the vertical element. In the figure, the horizontal element of the BAC is shown resting on a beam, thus supporting the weight of the apparatus. The vertical element is shown, positioned at a right angle from the horizontal element, and thus preventing movement of the BAC.

Figure 32:
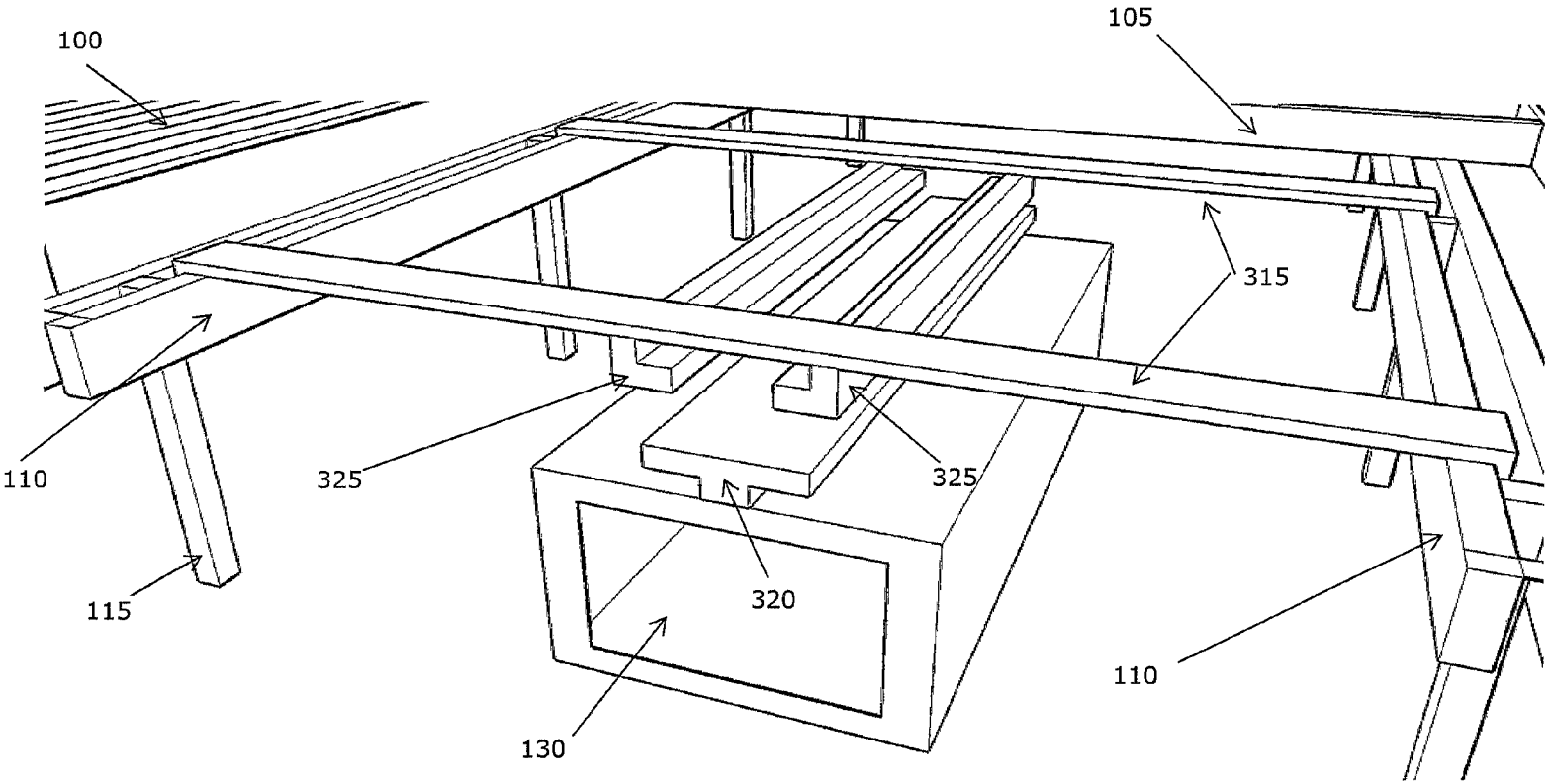
FIG. 32 is a perspective view of a deck anchoring apparatus according to a fifteenth embodiment.

FIG. 32 depicts an embodiment of one mechanism by which a storage component may attach to a beam anchoring component. In the figure, the components of the deck are shown to include a joist (105), beams (110) and posts (115). A storage component (SC) (130) is positioned underneath the deck. Beam anchoring components (BAC) (315) have been positioned. On the underside of the BACs are ledge attachment elements (LAE) (325). In the figure, an LAE is an "L"-shaped element that spans two or more BACs. An LAE and two or more BACs may be an integral unit. Alternatively, LAEs may be attached to BACs at the time of use. The figure show two LAEs oriented to form a ledge. The storage component in the figure has been modified with a "T"-attachment element (TAE) (320). A TAE may be integrated into a SC at the time of construction. Alternatively, a TAE may reversibly attach to an SC and thus assembled at the time of need. The horizontal elements of the TAE may be placed on the ledge created by the two LAEs. This may allow the SC to be suspended from the LAEs. The SC may be moveable forward and backward on the LAEs. This may be facilitated with rollers or bearings. In another embodiment of the apparatus the location of the TAE and LAEs are reversed wherein a TAE is positioned on BACs and LAEs are on an SC.

Figure 33:
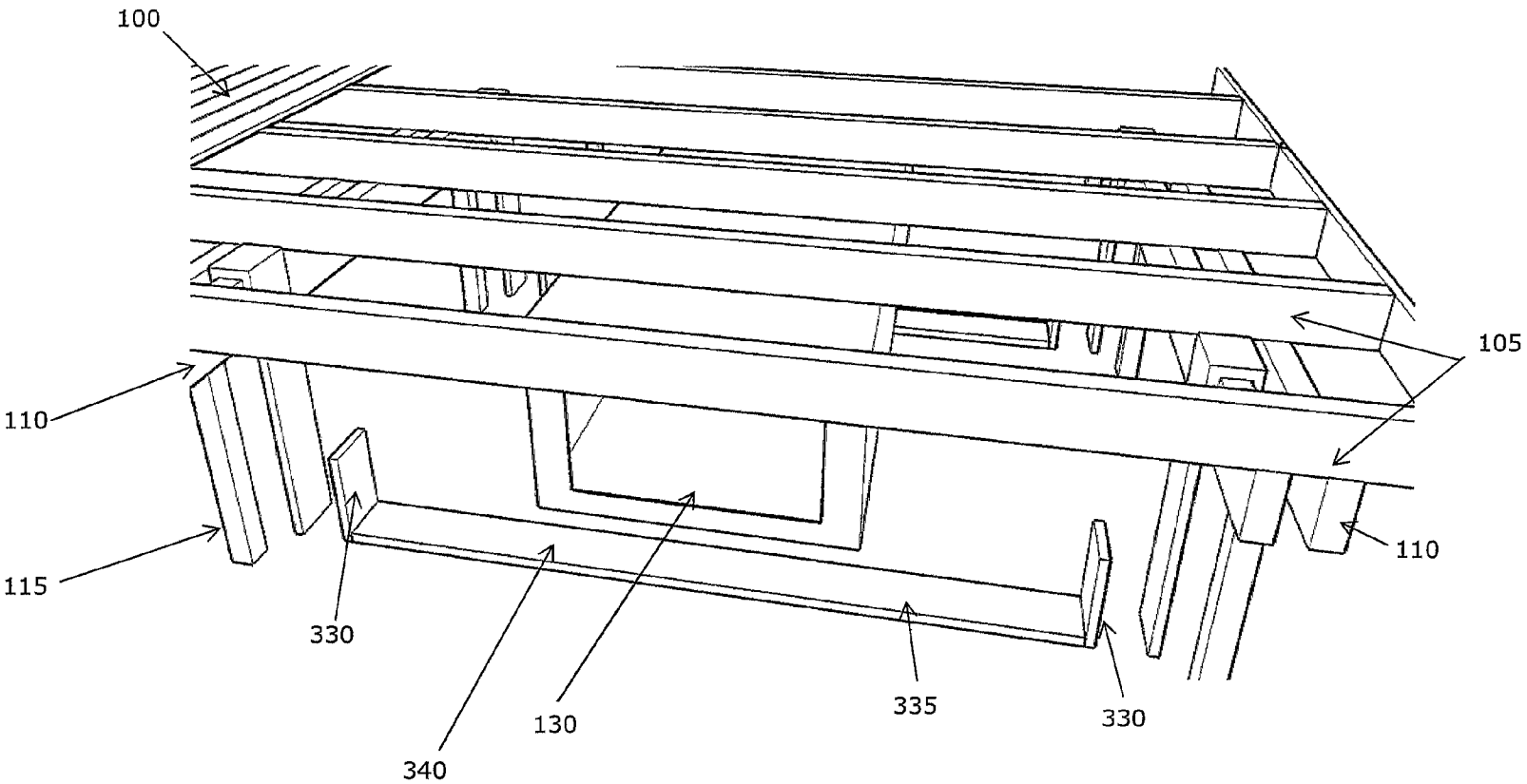
FIG. 33 is a perspective view of a deck anchoring apparatus according to a sixteenth embodiment.

FIG. 33 depicts an embodiment of the apparatus in which the anchoring components are placed on beams. In the figure, the components of the deck are shown to include the planks (100), a joist (105), a beam (110) and a post (115). A storage component (SC) (130) is positioned underneath the deck. The figure shows two components used to suspend the apparatus from beams. In this embodiment a combined beam anchoring vertical component (CBAVC) (330) is shown. A CBAVC is essentially an inverted square "J"-shaped anchoring element that may be placed on a beam. The "J" area of a CBAVC may be adjustable in size to accommodate beams of different dimensions. A CBAVC may be secured to a beam via screws or other mechanisms. Extending from the "J"-shaped anchoring element there is a vertical element extending downward. This element may provide for an area of attachment for a shelf (340) on which an SC may rest. The shelf may include vertical elements (335) that may interact with the vertical element of a CBAVC. This interact may be carried out by means of screws or bolts or various clasps.

Figure 34:
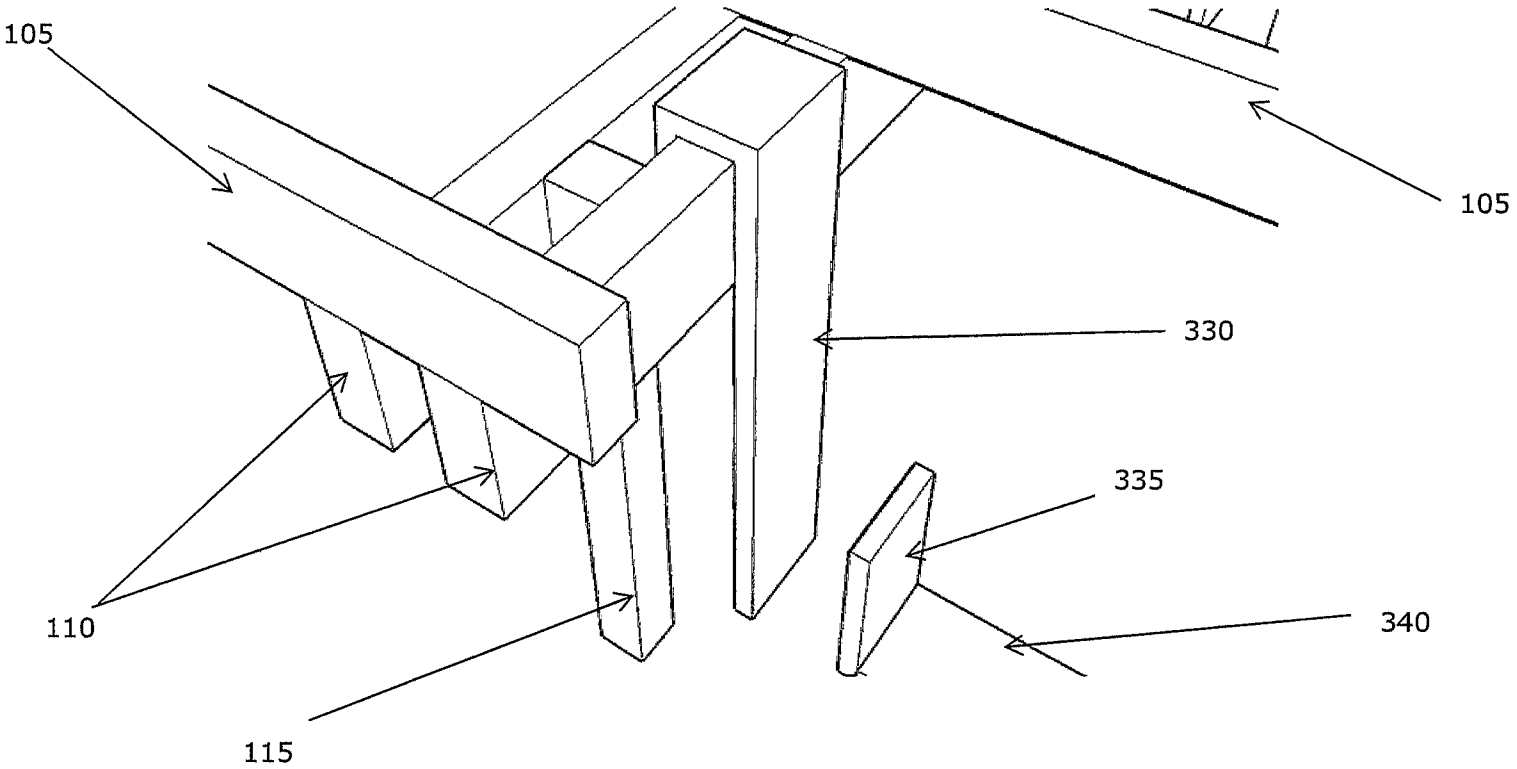
FIG. 34 is a blown-up perspective view of the deck anchoring apparatus of FIG. 33.

FIG. 34 depicts an embodiment of the apparatus in which the anchoring components are placed on beams. In the figure, the components of the deck are shown to include the joists (105), beams (110) and a post (115). A combined beam anchoring vertical component (CBAVC) (330) is shown positioned on a beam. In proximity, a shelf (340) is shown. The shelf may be constructed with vertical elements (335) which may interact with the vertical elements of a CBAVC.

Figure 35:
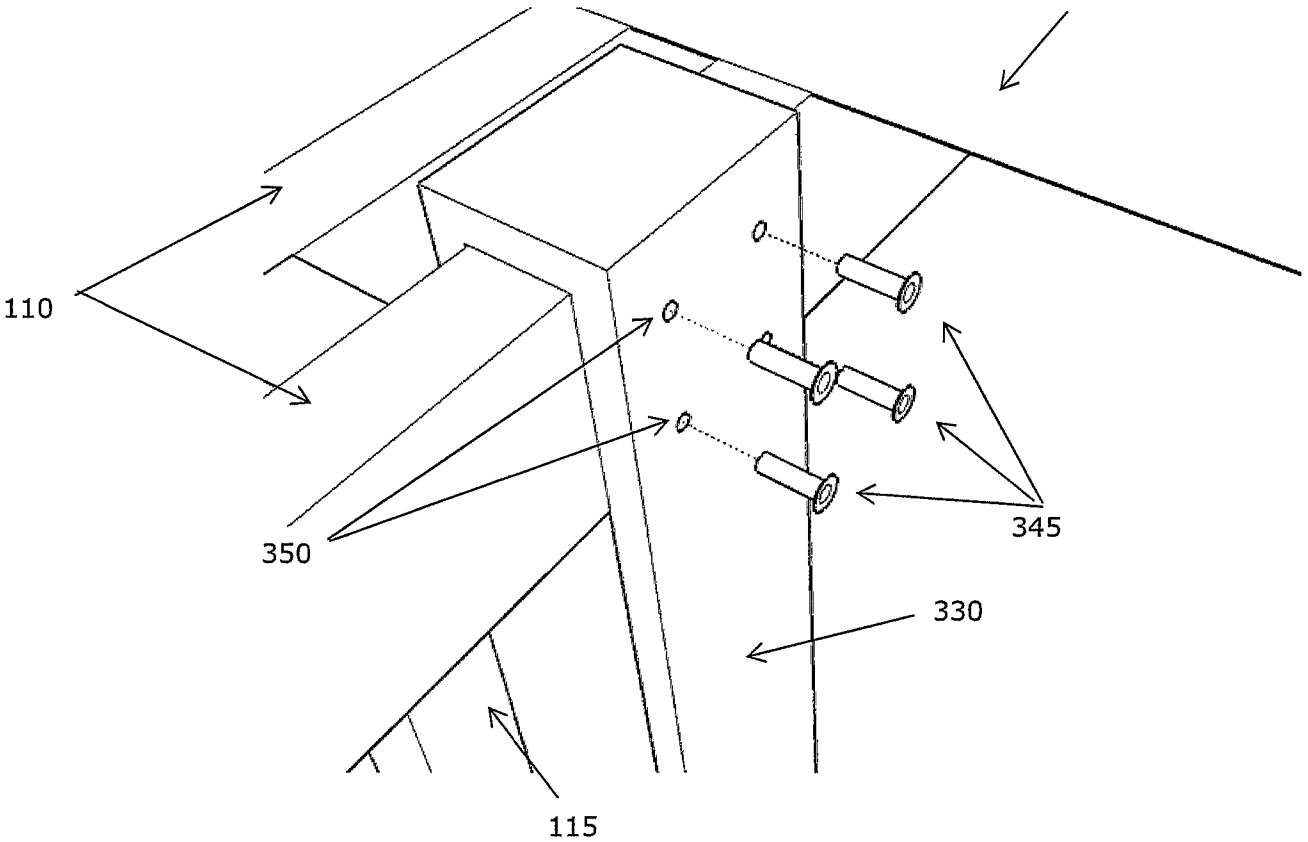
FIG. 35 is a blown-up perspective view of the deck anchoring apparatus of FIG. 33 having further securing means.

FIG. 35 depicts an embodiment of the apparatus in which the anchoring components are placed on beams. In the figure, the components of the deck are shown to include a joist (105), beams (110) and a post (115). A combined beam anchoring vertical component (CBAVC) (330) is shown as positioned on a beam. In the figure, screws or nails (345) are shown as securing the CBAVC to the beam.

Figure 36:
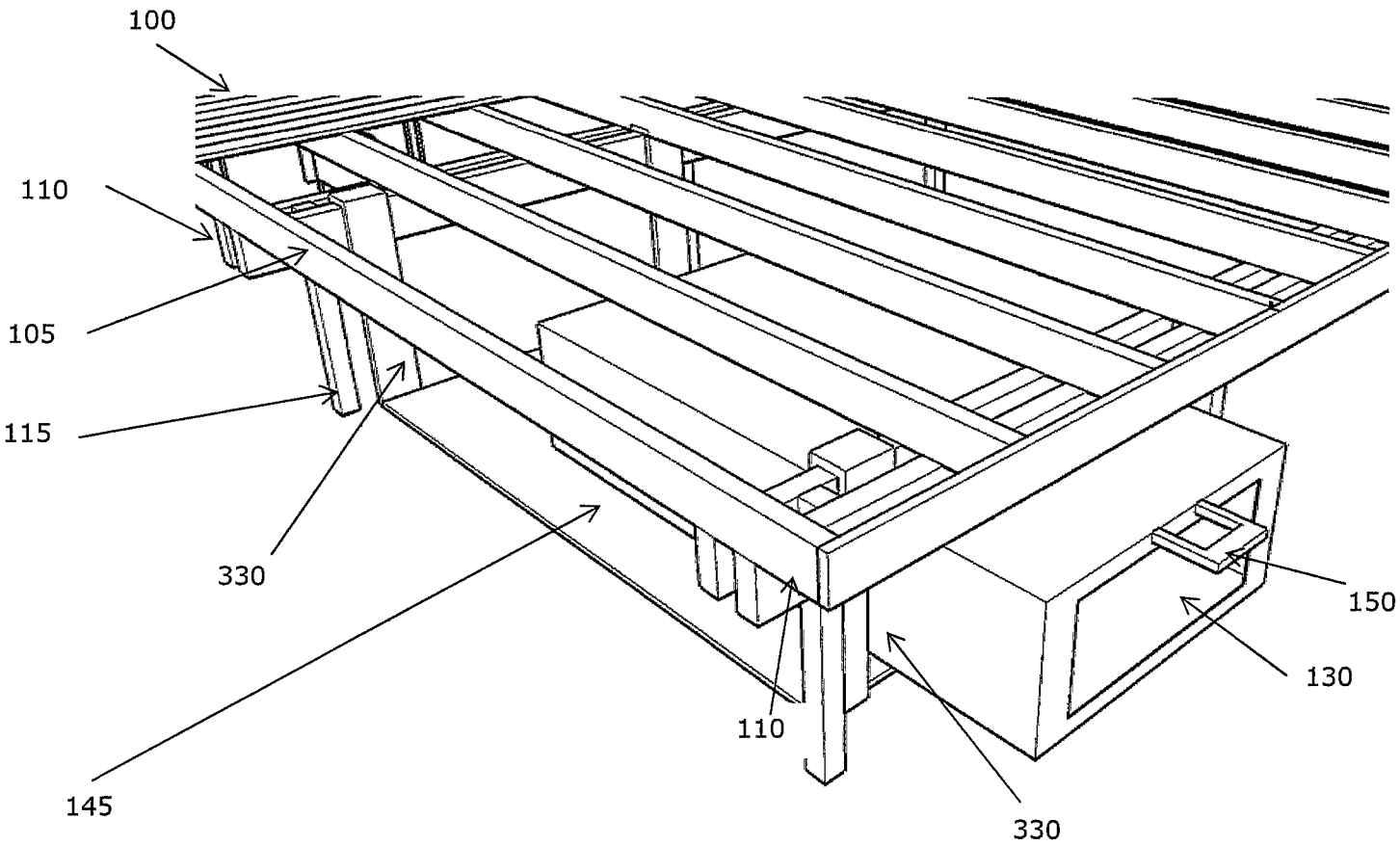
FIG. 36 is a perspective view of a deck anchoring apparatus according to a seventeenth embodiment.

FIG. 36 depicts an embodiment of the apparatus in which the anchoring components are placed on beams. In the figure, the components of the deck are shown to include the planks (100), a joist (105), a beam (110) and a post (115). A storage component (SC) (130) is positioned underneath the deck. In the figure, the combined beam anchoring vertical components (CBAVCs) have attached to a sliding platform (145) allowing the SC to move back and forth. This may be facilitated with the handle (150) shown on the SC. This embodiment depicts that it is envisioned that the elements and components described are interchangeable so that various components that are utilized to suspend the apparatus from the decking structures may be interchanged with various components on which a storage component rests.

Figure 37:
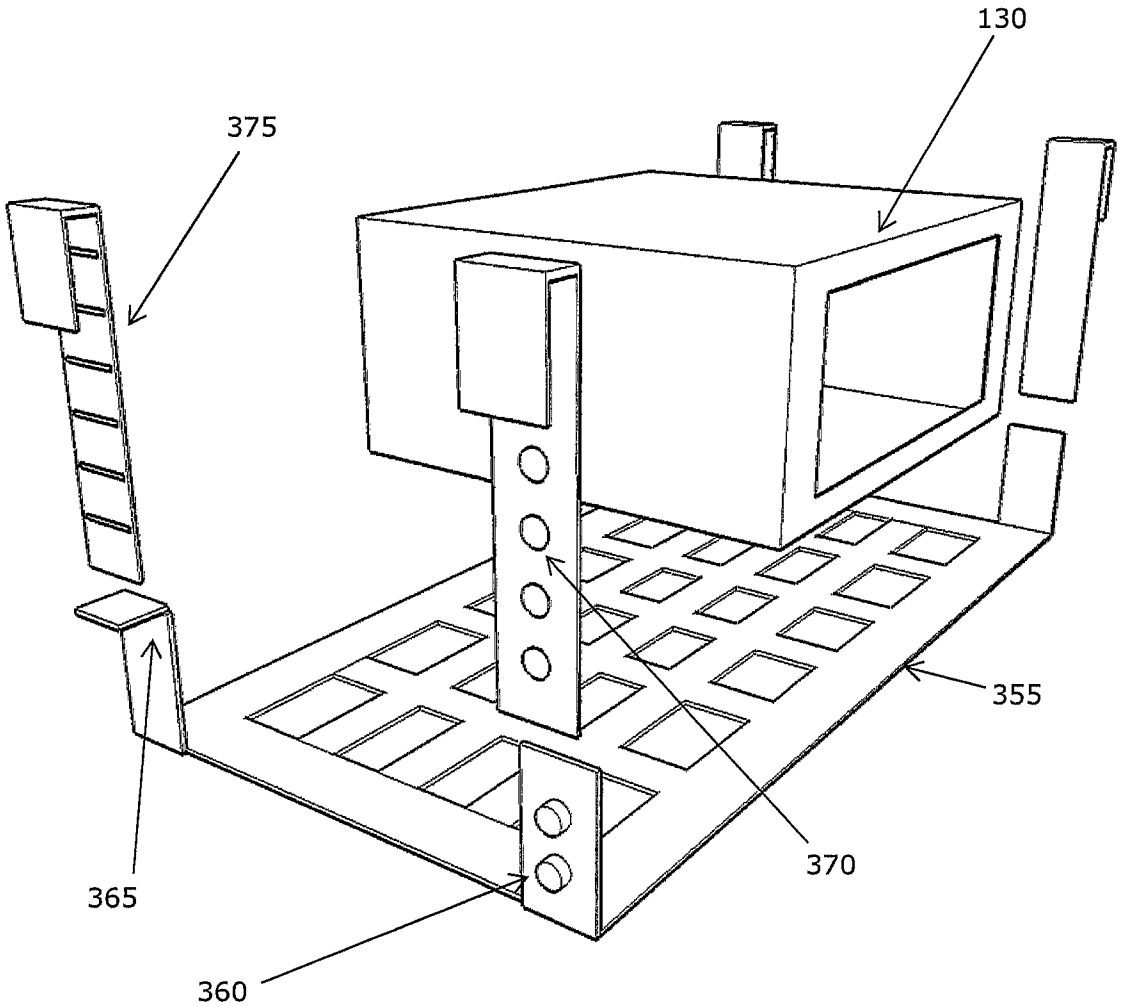
FIG. 37 is a perspective view of a deck anchoring apparatus according to an eighteenth embodiment.

FIG. 37 depicts an embodiment of the apparatus in which the anchoring components are placed on beams. A storage component (SC) (130) is shown above a fenestrated platform (FP) (355) on which it may eventually rest. Two combined beam anchoring vertical components (CBAVC) are shown. In the right of the figure, a CBAVC is shown with holes (370). The holes may interact with a platform attachment element with pegs (PAEP) (360). In the left of the figure, a CBAVC is shown with slots (375). The slots may interact with a platform attachment element with a ledge (PAEL).

Figure 38:
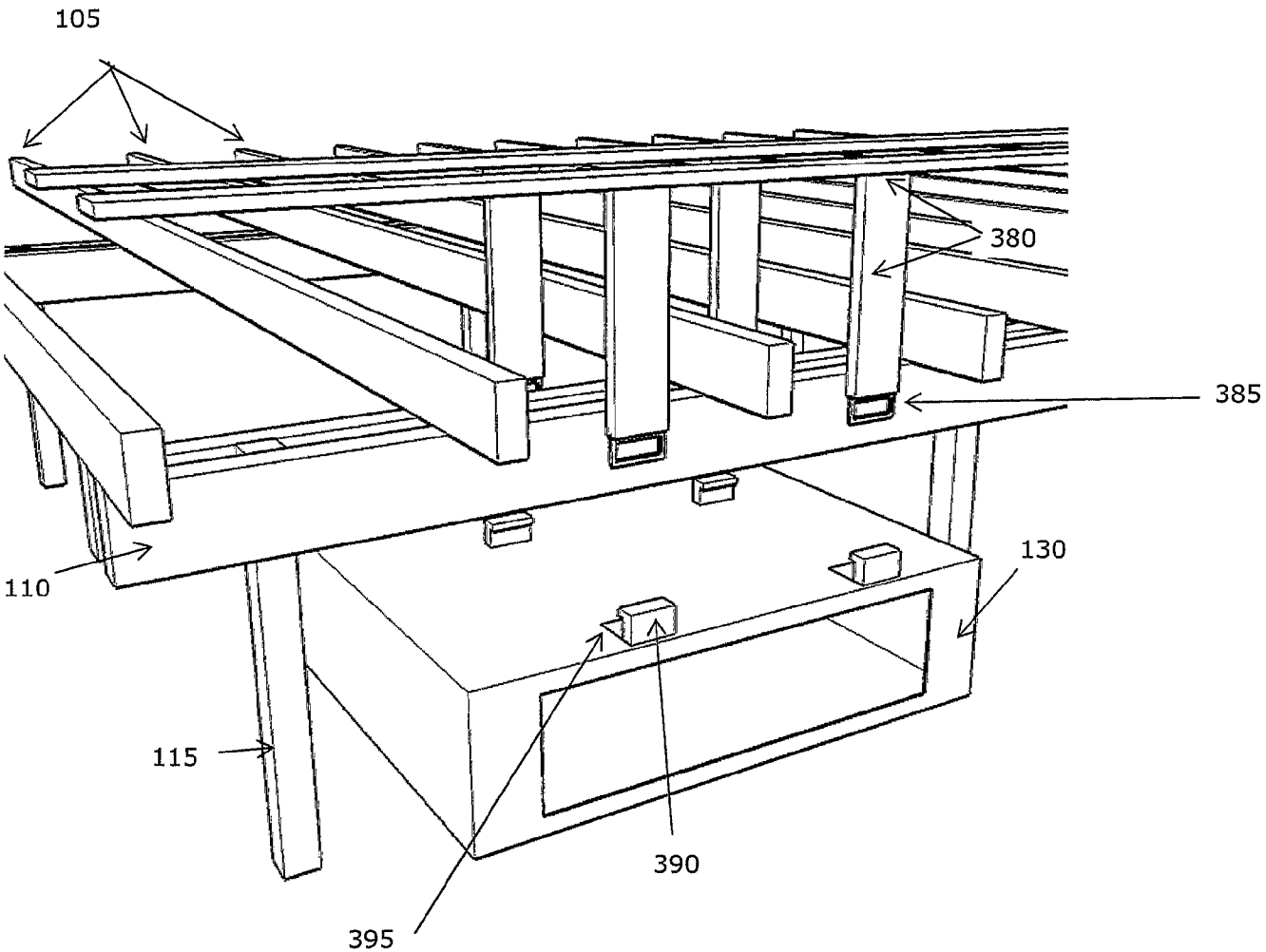
FIG. 38 is a perspective view of a deck anchoring apparatus according to a nineteenth embodiment.

FIG. 38 depicts an embodiment of the apparatus in which vertical components are integrated into the decking planks (100). In the figure, the components of the deck are shown to include joists (105), beams (110) and posts (115). A storage component (SC) (130) is positioned underneath the deck. In this embodiment of the apparatus a vertical component interacts directly with a deck plank (100) eliminating the need for an anchoring component. In the figure, an integrated decking vertical component (IDVC) (380) is shown. The deck plank (100) and vertical element may be integrated at the time of manufacturing. Alternatively, the use may attach the vertical element at the time of need. An IDVC may be placed on the deck at the time of deck construction. It is also envisioned that old deck planks may be removed and replaced with an IDVC or IDVCs. An IDVC may be constructed with an interacting element (385) that provides a mechanism of interaction. In the figure, the interacting element is in the form of a rectangular ring. An SC in this embodiment may be constructed with an element that may allow for attachment to an IDVC. In the figure, the SC has been constructed with interacting hooks (390). The hooks may be placed onto the ring-like interacting elements. To facilitate this attachment an interacting hook may be placed on an interacting hook track (AHT) (395). With the opposing interacting hooks facing each other the AHTs may allow the user to place the back hooks on the rings, align the front AHT with rings and the move the front AHT toward the front hooks for a secure attachment.

Figure 39:
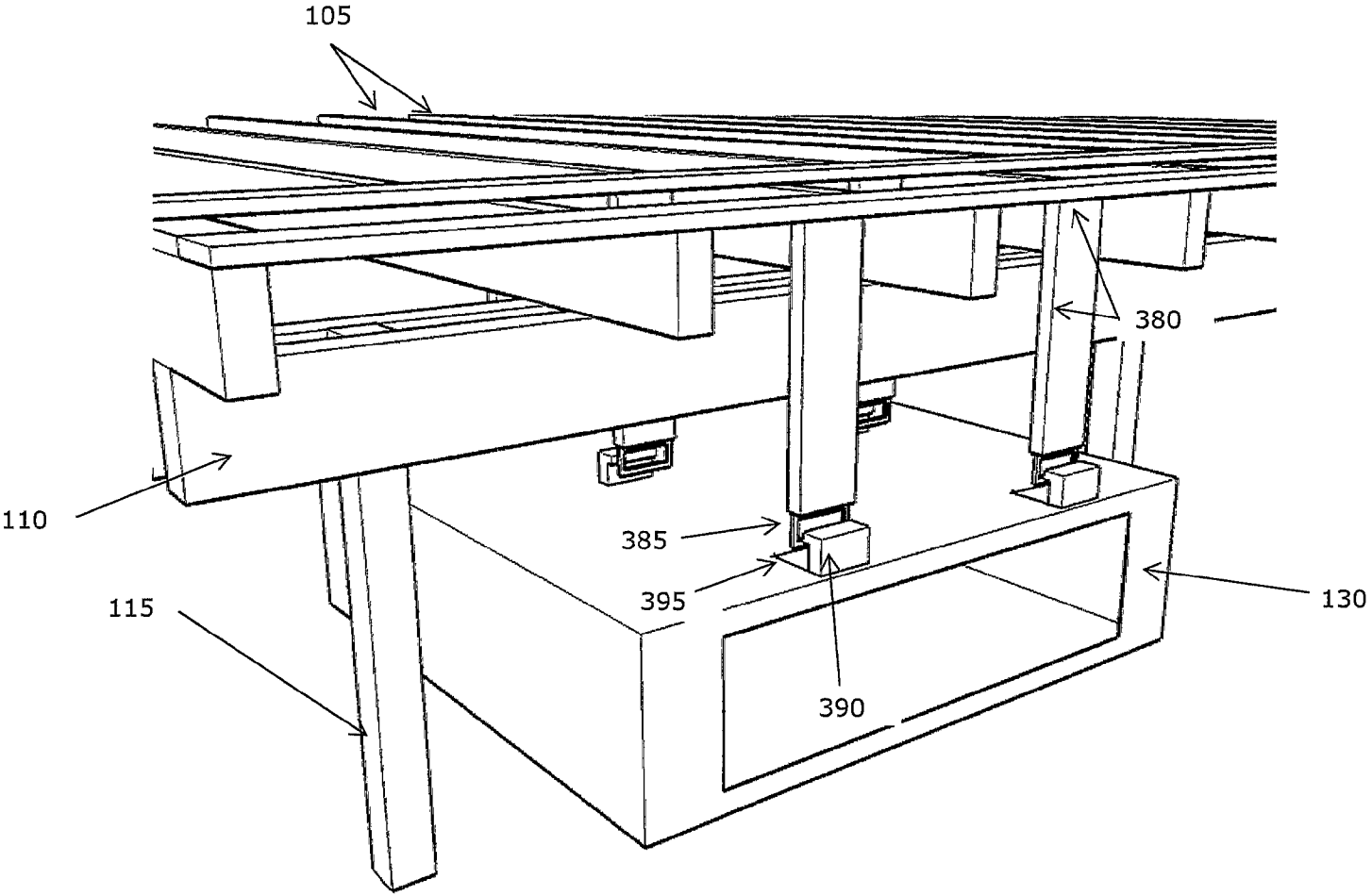
FIG. 39 is a blown-up perspective view of the deck anchoring apparatus of FIG. 38.

FIG. 39 depicts an embodiment of the apparatus in which vertical components are integrated into decking planks (100). In the figure, the components of the deck are shown to include joists (105), beams (110) and posts (115). A storage component (SC) (130) is positioned underneath the deck. In this embodiment of the apparatus a vertical component interacts directly with a deck plank (100) eliminating the need for an anchoring component. In the figure, an integrated decking vertical component (IDVC) (380) is shown. The deck plank (100) and vertical element may be integrated at the time of manufacturing. Alternatively, the use may attach the vertical element at the time of need. An IDVC may be placed on the deck at the time of deck construction. It is also envisioned that old deck planks may be removed and replaced with an IDVC or IDVCs. An IDVC may be constructed with an interacting element (385) that provides a mechanism of interaction. In the figure, the interacting element is in the form of a rectangular ring. An SC in this embodiment may be constructed with an element that may allow for attachment to an IDVC. In the figure, the SC has been constructed with interacting hooks (390). The hooks may be placed onto the ring-like interacting elements. To facilitate this attachment an interacting hook may be placed on an interacting hook track (AHT) (395). With the opposing interacting hooks facing each other the AHTs may allow the user to place the back hooks on the rings, align the front AHT with rings and the move the front AHT toward the front hooks for a secure attachment. This figure depicts a view wherein the SC has been readied for attachment to an integrated decking vertical component (IDVC) (380) through its interaction with an interacting element (385). In the figure, the interacting hooks in the back have been engaged with the interacting elements on the IDVCs. The interacting hooks in the front may be engaged with the interacting elements as the interacting hooks may be moved along the interacting hook tracks.

Figure 40:
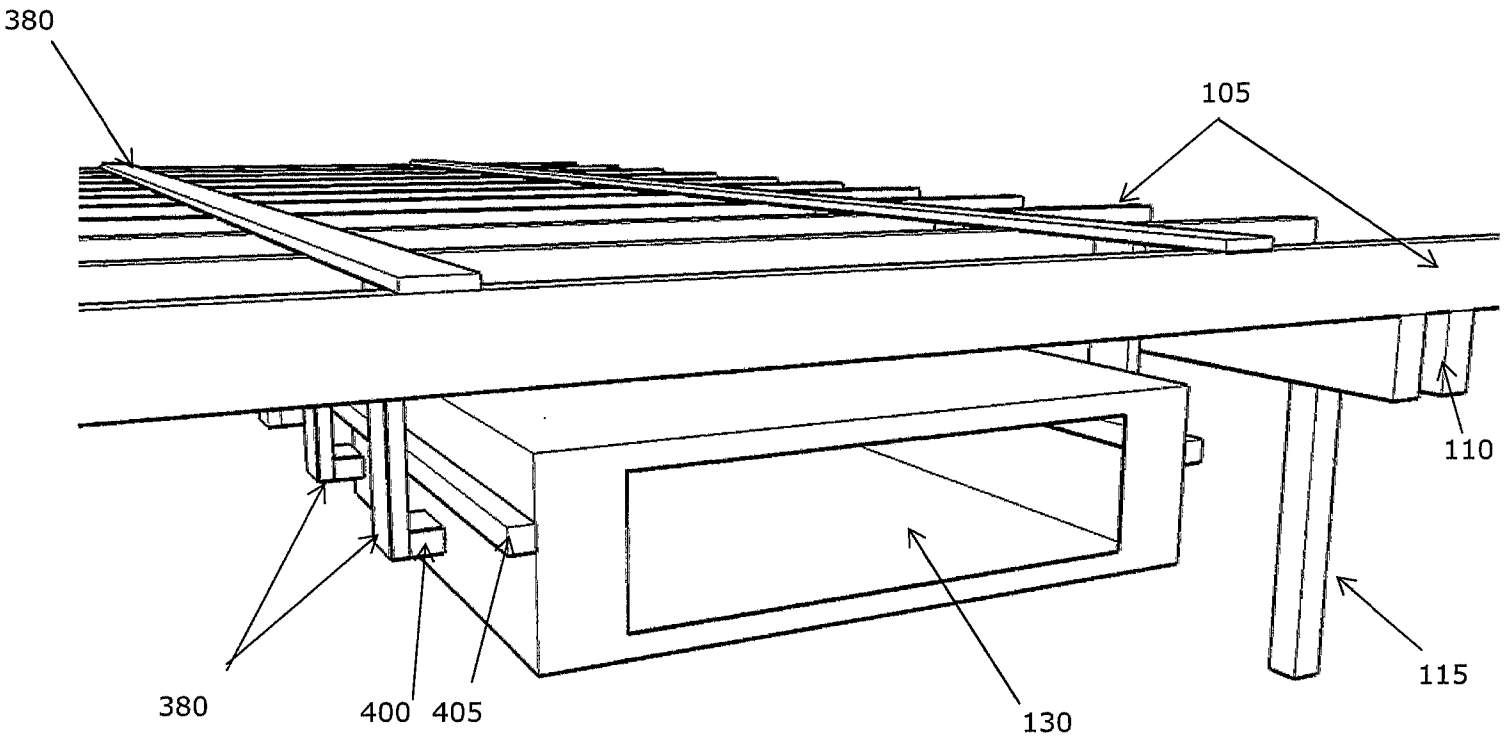
FIG. 40 is a perspective view of a deck anchoring apparatus according to a twentieth embodiment.

FIG. 40 depicts an embodiment of the apparatus in which vertical components are integrated into decking planks (100). In the figure, the components of the deck are shown to include joists (105), beams (110) and posts (115). A storage component (SC) (130) is positioned underneath the deck. In this embodiment of the apparatus a vertical component interacts directly with a deck plank (100) eliminating the need for an anchoring component. In the figure, an integrated decking vertical component (IDVC) (380) is shown. The deck plank (100) and vertical element may be integrated at the time of manufacturing. Alternatively, the use may attach the vertical element at the time of need. An IDVC may be placed on the deck at the time of deck construction. It is also envisioned that old deck planks may be removed and replaced with an IDVC or IDVCs. In the figure, the IDVCs have been constructed with interacting ledge (AL) (400). An AL may be attached to an IDVC at the time of construction or at the time of need by the user. Two or more ALs may provide a surface whereon an interacting bar (AB) (405) may be placed. An AB is designed as an element that may be designed to function to provide for interaction between an SC and an AL of an IDVC. An AB may be constructed so that it is a contiguous element that is of equal length of an SC. Alternatively, an AB may be discontinuous and be present only in areas where an AB may interact with an AL.

Figure 41:
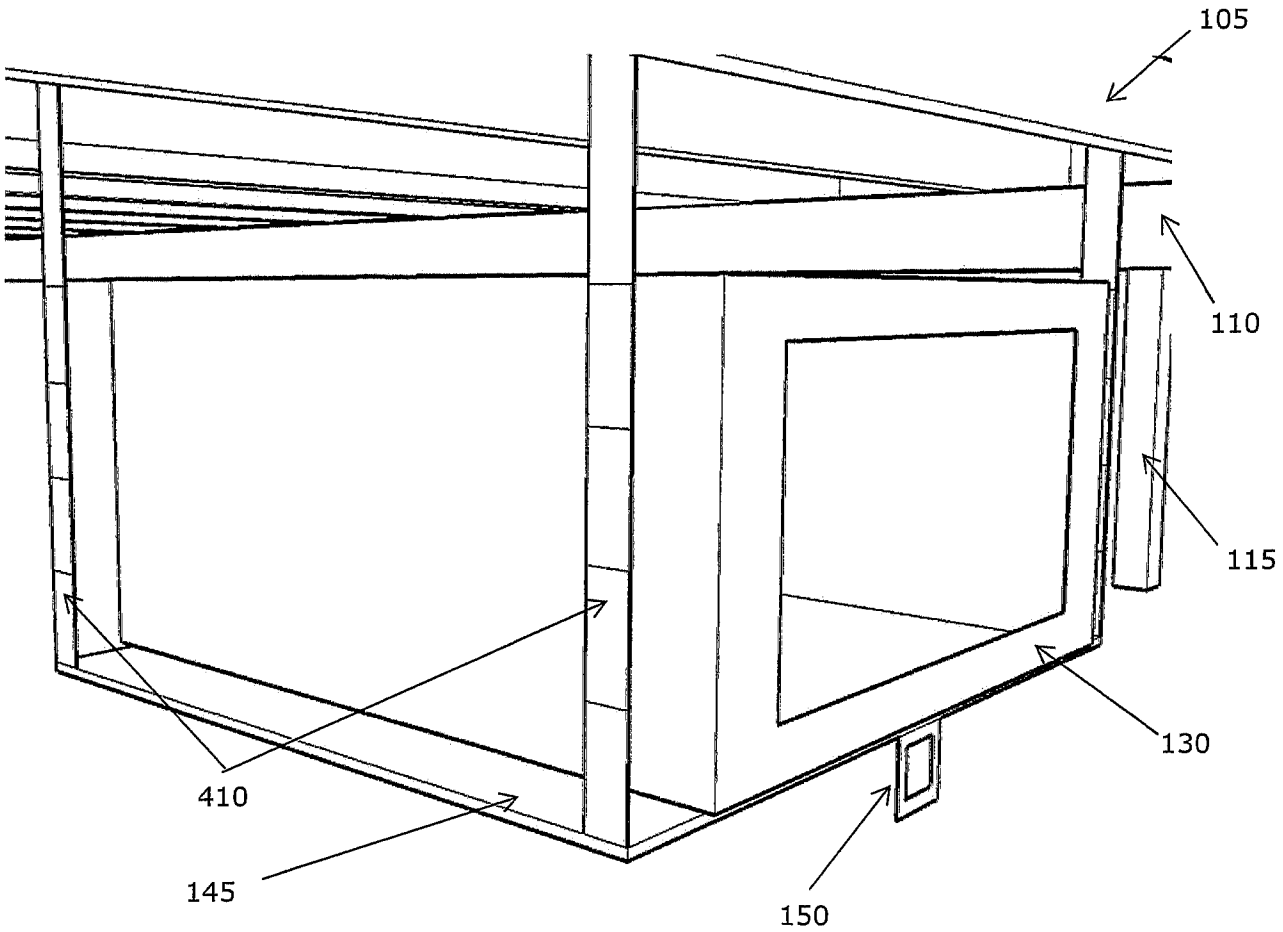
FIG. 41 is a perspective view of a deck anchoring apparatus according to a twenty-first embodiment.

FIG. 41 depicts an embodiment of the apparatus in which vertical components are modified to allow the storage component to move toward and away from the decking. In the figure, the components of the deck are shown to include joists (105), beams (110) and posts (115). A storage component (SC) (130) with is positioned underneath the deck resting on a sliding platform (SP) (145) with a handle (150). The SP is suspended on specialized telescoping vertical components (TVC) (410). The TVCs will allow the SP, and thus the SC, to move up (toward the undersurface of the deck) and down (away from the undersurface of the deck). The TVCs may be constructed with a locking mechanism that may allow the uses to secure an SC in a desired position.

Figure 42:
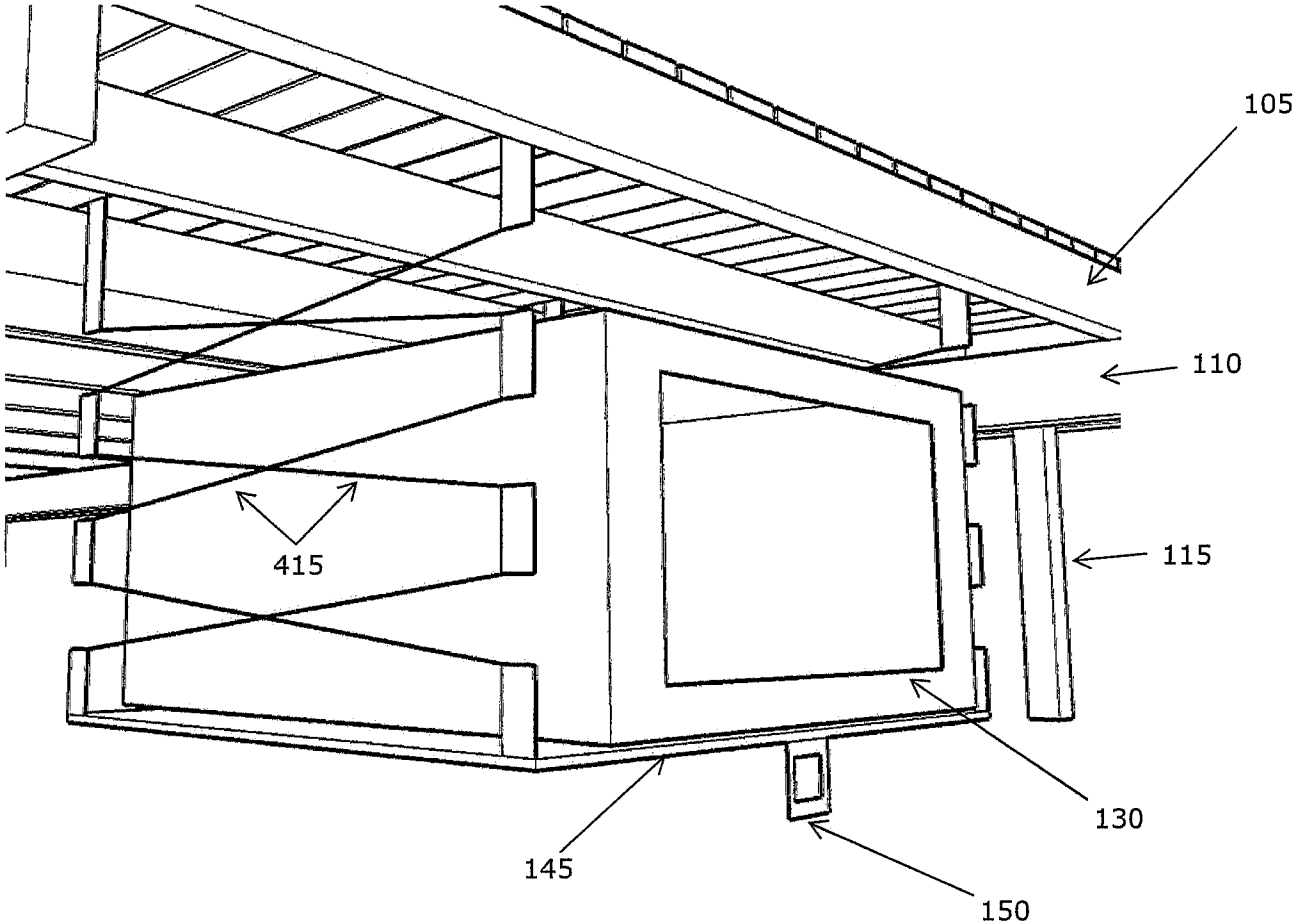
FIG. 42 is a perspective view of a deck anchoring apparatus according to a twenty-second embodiment.

FIG. 42 depicts an embodiment of the apparatus in which vertical components are modified to allow the storage component to move toward and away from the decking. In the figure, the components of the deck are shown to include joists (105), beams (110) and posts (115). A storage component (SC) (130) with is positioned underneath the deck resting on a sliding platform (SP) (145) with a handle (150). The SP is suspended on specialized scissoring vertical components (SVC) (410). The SVCs will allow the SP, and thus the SC, to move up (toward the undersurface of the deck) and down (away from the undersurface of the deck). The SVCs may be constructed with a locking mechanism that may allow the uses to secure an SC in a desired position. In other embodiments of the apparatus scissoring or telescoping vertical components may interact more directly with a storage component without the use of a platform. This interaction may occur in the way of pins and openings or pins and hooks as described in previous versions of the apparatus.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment may be combined with one or more features of any other embodiment.

The invention claimed is:

1. A system for utilizing space under a deck for storage, the system comprising: a deck, and a pair of securing elements, each securing element having a i) deck engaging support portion configured to extend across an upper surface of one of at least one deck plank, deck beam or deck joist, and ii) at least two hanging portions coupled to the deck engaging support portion at spaced locations along the deck engaging support portion wherein each hanging portion extends downward therefrom toward the ground and wherein at least one hanging portion is configured to be on one side of the at least one deck plank, deck beam or deck joist and at least another hanging portion is configured to be on the opposed side of the at least one deck plank, deck beam or deck joist whereby each securing element is configured to straddle the at least one deck plank, deck beam or deck joist; and a storage element sized to be received beneath the deck, wherein each hanging portion of each securing element is secured to the storage element.

2. The system of claim 1, wherein the hanging portions of one securing element is coupled to one side of the storage element and the hanging portions of the other securing element are coupled to the storage element on an opposite side of the storage element.

3. The system of claim 1, wherein the hanging portions of each securing element are substantially perpendicular to the deck engaging support portion, and wherein the hanging portions of each securing element are configured to be received in a space defined between two adjacent deck planks of the deck.

4. The system of claim 1, wherein the deck engaging support portion configured to extend across an upper surface of at least one deck plank of the deck.

5. The system of claim 1, wherein the deck engaging support portion configured to extend across an upper surface of a plurality of adjacent deck planks of the deck.

6. The system of claim 1, wherein the deck engaging support portion configured to extend across an upper surface of a deck beam of the deck.

7. The system of claim 1, wherein the deck engaging support portion configured to extend across an upper surface of a deck joist of the deck.

8. The system of claim 7, wherein the securing elements are secured to the respective joists via fasteners.

9. The apparatus of claim 1, wherein the securing elements are extendable in a direction perpendicular to the deck.

10. The apparatus of claim 1, wherein the storage element is movable in a direction parallel to the deck.

11. The system of claim 1, wherein the storage element includes an enclosure having at least one open end.

12. A system for utilizing space under a deck for storage, the system comprising: a deck, and a pair of securing elements, each securing element having a i) deck engaging support portion configured to extend across an upper surface of one of a plurality of adjacent deck planks or a plurality of adjacent deck joists, and ii) at least two hanging portions coupled to the deck engaging support portion at spaced locations along the deck engaging support portion wherein each hanging portion extends downward therefrom toward the ground and wherein at least one hanging portion is configured to be on one side of the plurality of adjacent deck planks or plurality of adjacent deck joists and at least another hanging portion is configured to be on the opposed side of the plurality of adjacent deck planks or plurality of adjacent deck joists whereby each securing element is configured to straddle the plurality of adjacent deck planks or plurality of adjacent deck joists; and a storage element sized to be received beneath the deck, wherein each hanging portion of each securing element is secured to the storage element, wherein the storage element includes an enclosure having at least one open end.

13. The system of claim 12, wherein the deck engaging support portion configured to extend across an upper surface of a plurality of adjacent deck planks of the deck.

14. The system of claim 12, wherein the deck engaging support portion configured to extend across an upper surface of a plurality of adjacent deck joists of the deck.

15. The system of claim 12, wherein the hanging portions of each securing element are substantially perpendicular to the deck engaging support portion, and wherein the hanging portions of each securing element are configured to be received in a space defined between two adjacent deck planks of the deck.

* * * * *